US009517172B2

(12) United States Patent
Kume et al.

(10) Patent No.: US 9,517,172 B2
(45) Date of Patent: Dec. 13, 2016

(54) ELECTRIC BED

(71) Applicant: Panasonic Intellectual Property Management Co., Ltd., Osaka (JP)

(72) Inventors: Yohei Kume, Osaka (JP); Shohei Tsukada, Hyogo (JP); Hideo Kawakami, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 0 days.

(21) Appl. No.: 14/647,239

(22) PCT Filed: Sep. 12, 2014

(86) PCT No.: PCT/JP2014/004740
§ 371 (c)(1),
(2) Date: May 26, 2015

(87) PCT Pub. No.: WO2015/040848
PCT Pub. Date: Mar. 26, 2015

(65) Prior Publication Data

US 2015/0313779 A1 Nov. 5, 2015

(30) Foreign Application Priority Data

Sep. 17, 2013 (JP) ..... 2013-191416

(51) Int. Cl.
*A61G 7/018* (2006.01)
*A61G 7/16* (2006.01)
(Continued)

(52) U.S. Cl.
CPC ..... *A61G 7/018* (2013.01); *A47C 20/041* (2013.01); *A47C 20/08* (2013.01); *A61G 7/012* (2013.01);
(Continued)

(58) Field of Classification Search
CPC ..... A47C 19/04; A47C 19/045; A61G 1/013; A61G 7/012; A61G 7/018; A61G 13/06; A61G 2203/70; A61G 2203/726
See application file for complete search history.

(56) References Cited

U.S. PATENT DOCUMENTS 8,677,523 B2 3/2014 Tsukada et al.
8,950,776 B2 2/2015 Tsukada et al.
(Continued)

FOREIGN PATENT DOCUMENTS

CN 102481219 5/2012
CN 102481223 5/2012
(Continued)

OTHER PUBLICATIONS

Office Action and Search Report issued Oct. 23, 2015 in Chinese Application No. 201480002804.3, with English translation.
(Continued)

*Primary Examiner* — Nicholas Polito
(74) *Attorney, Agent, or Firm* — Wenderoth, Lind & Ponack, L.L.P.

(57) ABSTRACT

An electric bed includes a first driver that performs rising and lowering operation of a second frame with respect to a first frame, a controller that controls the first driver, and an input unit that instructs the controller by switch manipulation of a lowering switch of the input unit. The controller controls the first driver to lower the second frame at a basic speed when a bed height is a first predetermined height or more during depression of the lowering switch, and to lower the second frame at a first low speed slower than the basic speed when the bed height is less than the first predetermined height during the depression of the lowering switch, in case where the bed height is a height of an upper surface of the second frame.

20 Claims, 22 Drawing Sheets

(51) Int. Cl.

| | |
|---|---|
| ***A47C 20/08*** | (2006.01) |
| ***A61G 7/012*** | (2006.01) |
| ***A61G 7/015*** | (2006.01) |
| ***A47C 20/04*** | (2006.01) |
| *A61G 7/05* | (2006.01) |

(52) U.S. Cl.

CPC ..... *A61G 7/015* (2013.01); *A61G 7/16* (2013.01); *A61G 2007/0528* (2013.01); *A61G 2007/165* (2013.01); *A61G 2203/12* (2013.01); *A61G 2203/40* (2013.01); *A61G 2203/70* (2013.01)

(56) References Cited

U.S. PATENT DOCUMENTS

| | | | |
|---|---|---|---|
| 2008/0276369 | A1 | 11/2008 | Hayes et al. |
| 2012/0117730 | A1 | 5/2012 | Lemire et al. |
| 2012/0153687 | A1 | 6/2012 | Kume et al. |
| 2012/0159705 | A1 | 6/2012 | Tsukada et al. |
| 2012/0181779 | A1 | 7/2012 | Tsukada et al. |
| 2014/0191541 | A1 | 7/2014 | Ohta et al. |

FOREIGN PATENT DOCUMENTS

| | | |
|---|---|---|
| CN | 102596140 | 7/2012 |
| JP | 2004-159807 | 6/2004 |
| JP | 4141233 | 8/2008 |
| JP | 2013-173075 | 9/2013 |
| WO | 2013/042334 | 3/2013 |

OTHER PUBLICATIONS

Extended European Search Report issued Dec. 11, 2015 in European Application No. 14845062.0.

Written Opinion of the International Searching Authority issued Oct. 14, 2014 in International (PCT) Application No. PCT/JP2014/004740, with English translation.

International Search Report issued Oct. 14, 2014 in International (PCT) Application No. PCT/JP2014/004740.

ELECTRIC BED

TECHNICAL FIELD

The present invention relates to an electric bed capable of performing rising and lowering operation of the bed.

BACKGROUND ART

An electric bed is used for caring, for example. This electric bed is composed so as to be capable of performing not only back lifting-up or back lifting-down operation, or knee lifting-up or knee lifting-down operation, but also rising and lowering operation for rising or lowering the bed. For example, a caregiver cares for a care receiver in a state where a bed is rised, so that the caregiver can perform caring work in an easy posture without bending his/her waist. Additionally, the care receiver lies on the bed in a state where the bed is lowered, the care receiver can reduce an impact in a case where the care receiver turns over and falls from the bed. FIG. 22 shows a schematic view of a conventional electric bed.

In the conventional bed 100 shown in FIG. 22, a switch provided in a remote controller 101 is pressed, so that an actuator is driven to perform rising and lowering operation of the bed. In the conventional bed 100, the operation is performed only while the switch is pressed, and the operation stops when a hand separates from the switch.

Recently, in the electric bed used for caring, the bed can be further lowered to a low position in order to reduce an impact in a case where a care receiver turns over and falls from the bed. When such a bed is lowered, a clearance between a lower end of the bed and a floor is reduced, thereby causing a possibility that a foot or the like of a caregiver or a care receiver is sandwiched between the lower end of the bed and the floor.

As a means for solving this problem, an electric bed, in which when the bed reaches a height at which a foot or the like may be sandwiched (hereinafter, sandwiching height), lowering operation stops once and warning is performed by a buzzer even a lowering switch of a remote controller is pressed, and when the lowering switch is pressed again, the lowering operation restarts, is proposed (see Patent Literature 1, for example).

CITATION LIST

Patent Literature

Patent Literature 1: JP 4141233 B2

SUMMARY OF INVENTION

Technical Problem

However, in the electric bed disclosed in Patent Literature 1, in a case where a caregiver manipulates the switch of the remote controller to lower the bed little by little while confirming a condition of a care receiver, there is a possibility that the caregiver lowers the bed without noticing that the lowering operation stops at the sandwiching height once, and a foot or the like is sandwiched between the lower end of the bed and the floor.

Additionally, in a case where a caregiver unfamiliar to manipulation manipulates the switch, the lowering operation suddenly stops at the sandwiching height, and therefore there is a possibility that the caregiver does not understand the cause of the stop of the lowering operation, and feels anxious about the manipulation.

The present invention has been made in view of such problems, and an object of the present invention is to provide an electric bed capable of further reliably preventing a foot or the like from being sandwiched also in a case where lowering operation of a bed is performed.

Solution to Problem

In accomplishing the objects, an electric bed according to the present invention is characterized by comprising:

a first driver that performs rising and lowering operation of a second frame with respect to a first frame;

a controller that controls the first driver; and an input unit that instructs the controller by switch manipulation of a lowering switch of the input unit, wherein the controller controls the first driver to lower the second frame at a basic speed when a bed height is a first predetermined height or more during depression of the lowering switch, and to lower the second frame at a first low speed slower than the basic speed when the bed height is less than the first predetermined height during the depression of the lowering switch, in a case where the bed height is a height of an upper surface of the second frame.

Advantageous Effects of Invention

The aspect of the present invention can provide an electric bed capable of further reliably preventing a foot or the like from being sandwiched.

DESCRIPTION OF EMBODIMENTS

Figure 1A:
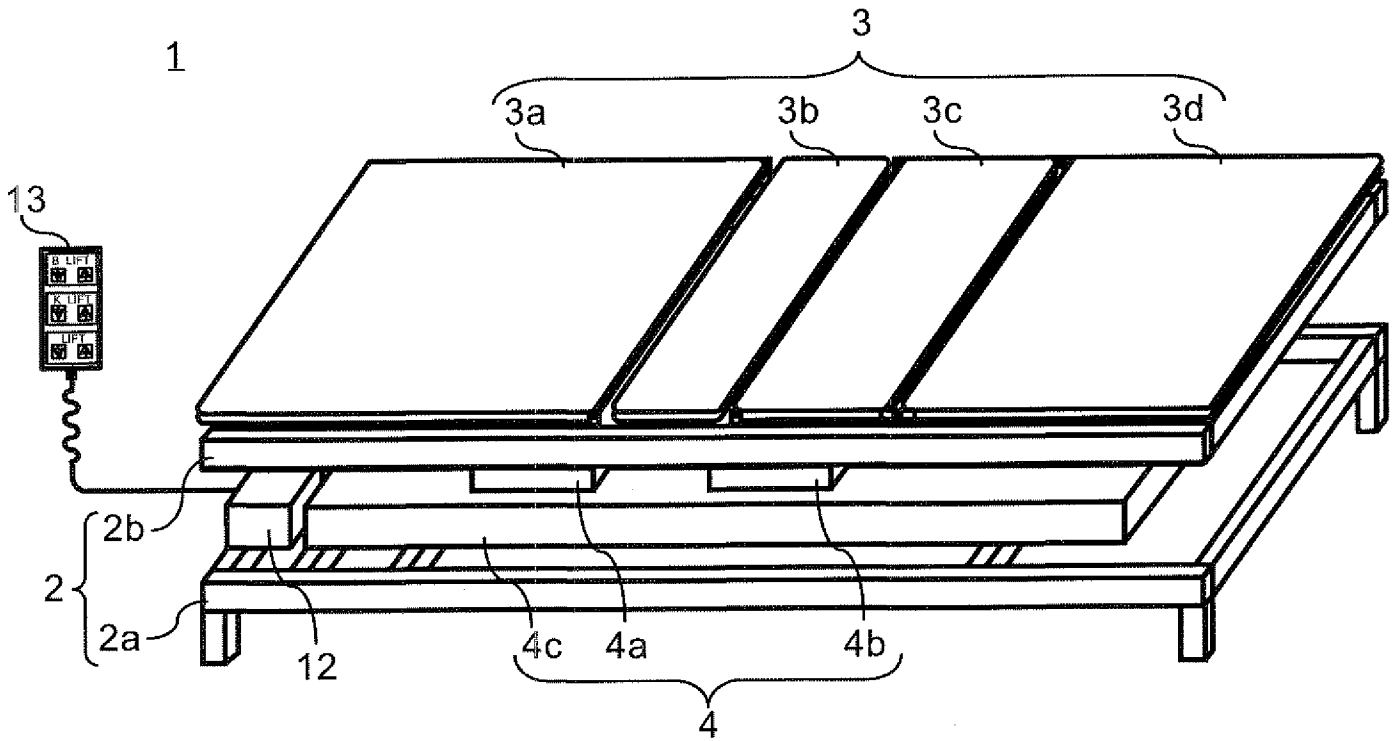
FIG. 1A is a schematic perspective view of an electric bed according to a first embodiment of the present invention.

Hereinafter, embodiments of the present invention are described with reference to the drawings. The same components are denoted by the same reference numerals, and description thereof is sometimes omitted. In order to facilitate understanding, the drawings schematically mainly illustrate the respective components.

First Embodiment

Figure 1C:
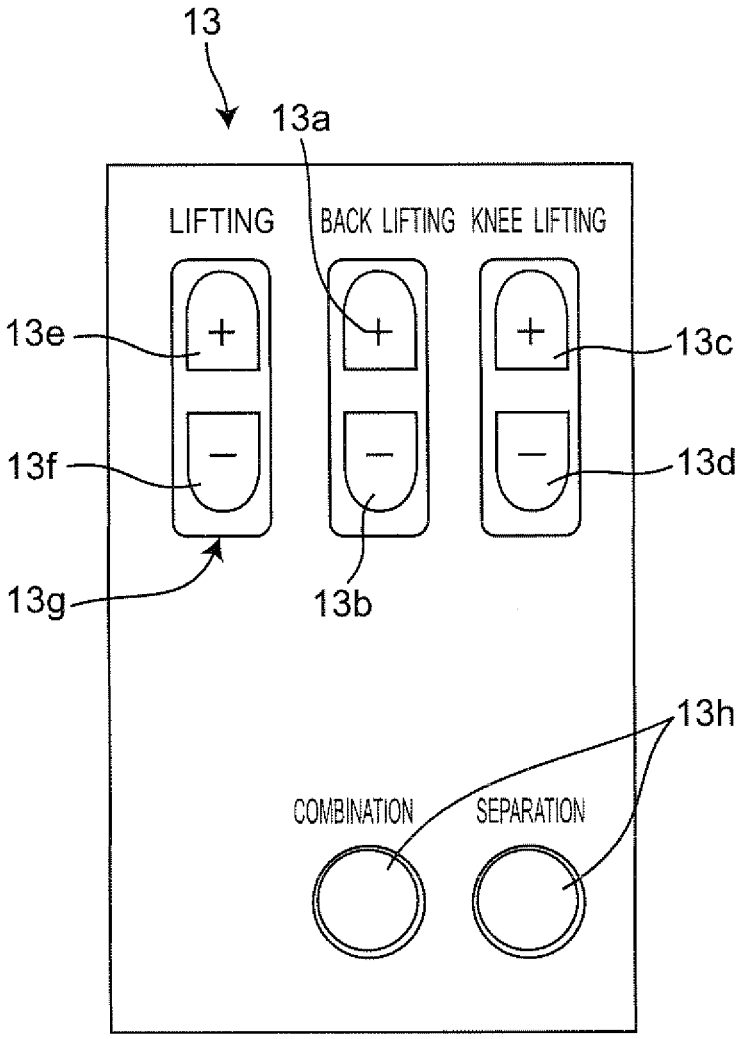
FIG. 1C is a front view of a remote controller of the electric bed of the first embodiment.
Figure 2:
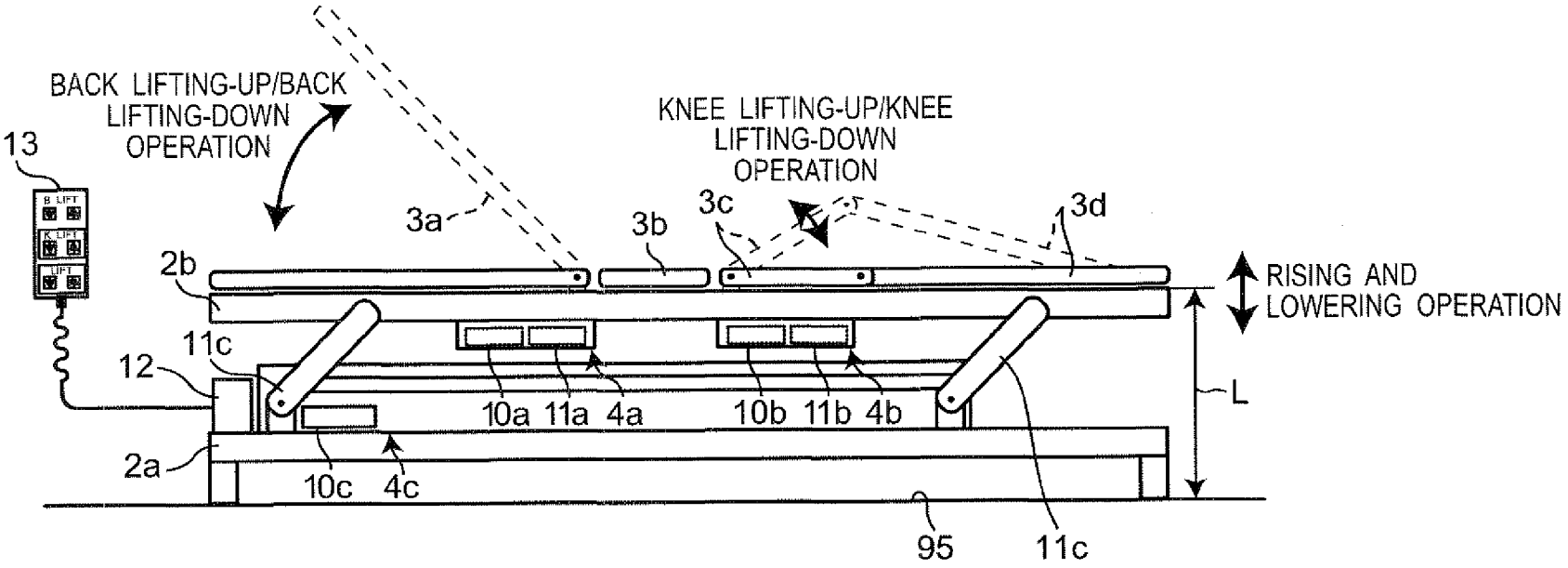
FIG. 2 is a front view of the electric bed of the first embodiment.
Figure 15:
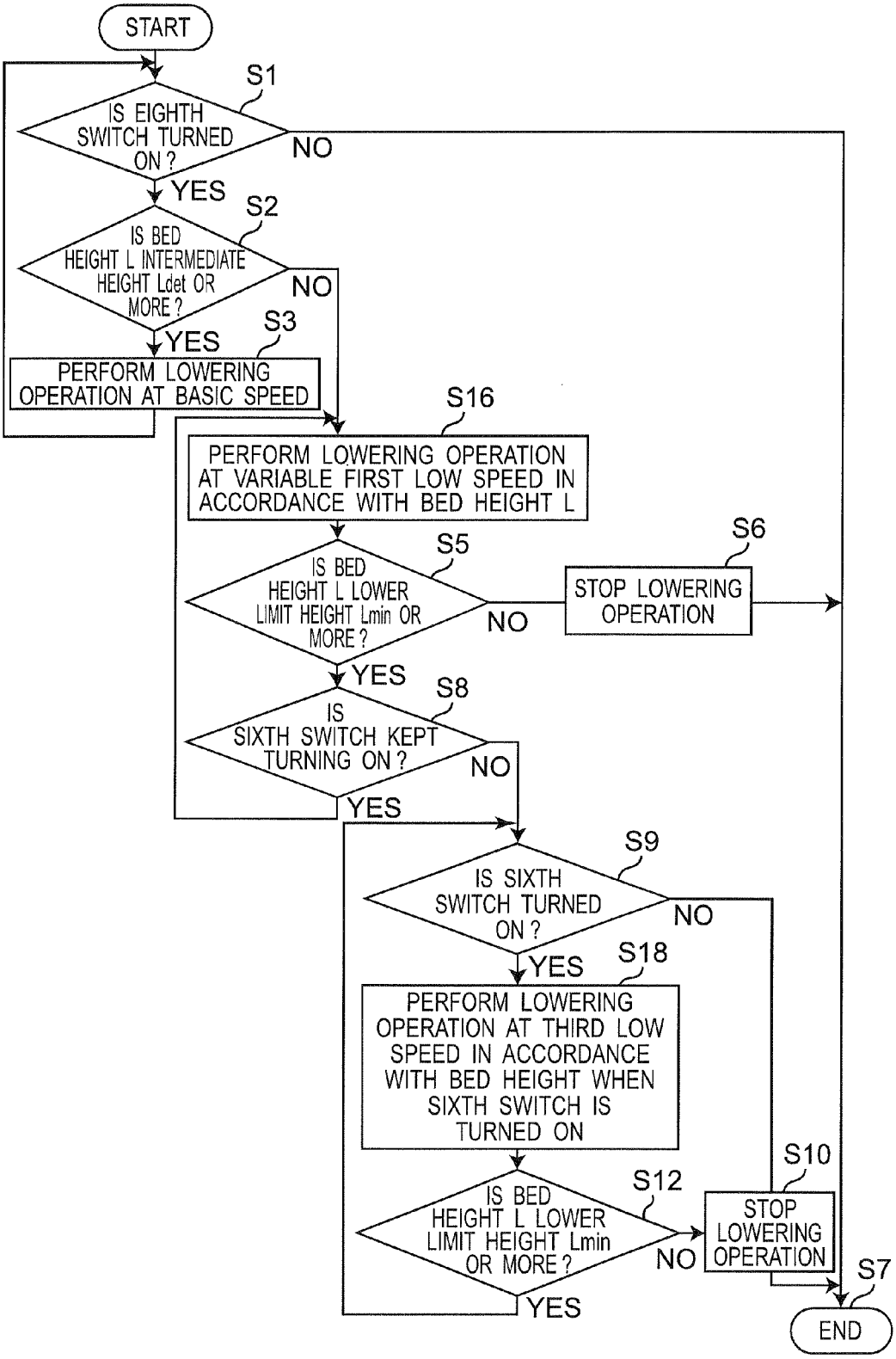
FIG. 15 is a flowchart showing eight lowering operation in the second embodiment.

FIG. 1A is a schematic perspective view of an electric bed according to a first embodiment of the present invention. FIG. 15 is a block diagram showing a configuration of a drive system and the like of the electric bed of the first embodiment. FIG. 1C is a front view of a remote controller of the electric bed of the first embodiment. FIG. 2 is a front view of the electric bed of the first embodiment.

Figure 1B:
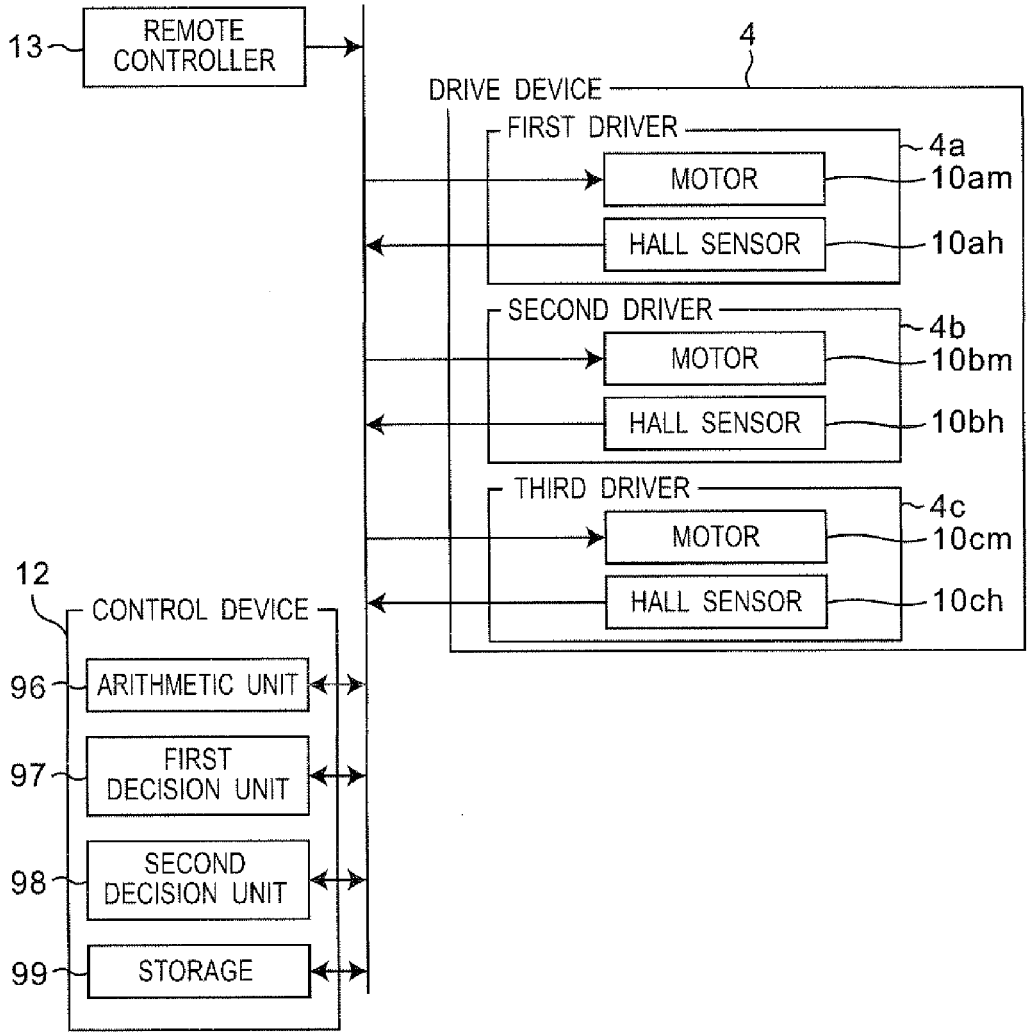
FIG. 1B is a block diagram showing a configuration of drive system and the like of the electric bed of the first embodiment.

As shown in FIG. 1A to FIG. 2, a bed 1 according to the first embodiment is composed of a bottom 3 on which a mattress for a bed is placed, a frame 2 that supports the bottom 3, a drive device 4, a control device 12 (controller), and a remote controller 13. The bed 1 is, for example, an electric bed. The remote controller 13 is an example of an input unit. In the first embodiment, the remote controller 13 is used as a wired remote controller, but may be used as a wireless remote controller as long as safety can be ensured.

The frame 2 is composed of a first frame 2*a* disposed on a lower side, and a second frame 2*b* disposed on the first frame 2*a*. The first frame 2*a* is, for example, a base frame that serves as a base of the frame 2. The second frame 2*b* is, for example, an upper frame disposed on an upper side of the frame 2.

The bottom 3 is composed of a first bottom 3*a*, a second bottom 3*b*, a third bottom 3*c*, and a fourth bottom 3*d* that are freely bendably coupled in an order from left to right of FIG. 1A. The first bottom 3*a* is, for example, a back bottom that comes into contact with a back of a care receiver. The second bottom 3*b* is, for example, a waist bottom that comes into contact with a waist and buttocks of the care receiver. The third bottom 3*c* is, for example, a knee bottom that comes into contact with thighs of the care receiver. The fourth bottom 3*d* is, for example, a foot bottom that comes into contact with legs of the care receiver. Each bottom is rotatably coupled to the adjacent bottom(s).

The drive device 4 (driver) is composed of a second driver 4*a*, a third driver 4*b*, and a first driver 4*c*. The second driver 4*a* is, for example, a back bottom driver that changes a posture of the back bottom. The third driver 4*b* is, for example, a knee bottom driver that changes a posture of the knee bottom. The first driver 4*c* is, for example, a rising and lowering driver that rises and lowers the second frame 2*b*.

The bed 1 is composed such that the second frame 2*b* is supported on the first frame 2*a* installed on a floor surface 95 of a sick room or the like through the first driver 4*c*, and the bottom 3 is disposed on the second frame 2*b*. Herein, the second bottom 3*b* of the bottom 3 is fixed to the second frame 2*b*.

The second driver 4*a* rises (or falls) the first bottom 3*a* rotatably coupled to the second bottom 3*b*, thereby performing back lifting-up operation (or back lifting-down operation) of the bed 1.

The third driver 4*b* rises (or falls) the third bottom 3*c* rotatably coupled to the second bottom 3*b* and the fourth bottom 3*d*, thereby performing knee lifting-up operation (or knee lifting-down operation) of the bed 1. The fourth bottom 3*d* operates in cooperation with the knee lifting-up operation (or knee lifting-down operation). The fourth bottom 3*d* is in contact with the second frame 2*b* on a side opposite to the third bottom 3*c*, and slides and moves along a longitudinal direction of the bed on the second frame 2*b* in cooperation with the knee lifting-up operation (or knee lifting-down operation).

The first driver 4*c* moves up and down the second frame 2*b* with respect to the first frame 2*a* in a direction perpendicular to the floor surface 95, thereby performing rising operation (or lowering operation) of the bed 1 including the bottom 3. A clearance between equipment attached to the second frame 2*b* and the second frame 2*b*, and the floor surface 95 changes by the rising operation (or lowering operation) of the bed 1. Particularly, in the lowering operation, the clearance reduces, and there is a possibility that a foot or the like of a caregiver or a care receiver is sandwiched between the instrument and the floor surface 95.

The second driver 4*a* has an actuator 10*a*, and a link mechanism 11*a* that is coupled to the first bottom 3*a* and changes operation of the actuator 10*a* to the back lifting-up operation (or back lifting-down operation). The third driver 4*b* has an actuator 10*b*, and a link mechanism 11*b* that is coupled to the third bottom 3*c* and changes operation of the actuator 10*b* to the knee lifting-up operation (or knee lifting-down operation). The first driver 4*c* has an actuator 10*c*, and a link mechanism 11*c* that is coupled to the second frame 2*b* and that changes operation of the actuator 10*c* to the rising and lowering operation. Additionally, the control device 12 that controls each operation is connected to the second driver 4*a*, the third driver 4*b*, and the first driver 4*c*.

To this control device 12, the remote controller 13 for giving an instruction of each operation by switch manipulation is connected.

The actuators 10*a*, 10*b*, and 10*c* each are a linear actuator capable of performing extending operation. The actuators 10*a*, 10*b*, and 10*c* include motors 10*am*, 10*bm*, and 10*cm*, and hall sensors 10*ah*, 10*bh*, and 10*ch* that measure rotation amounts of the motors 10*am*, 10*bm*, and 10*cm*, respectively. Information detected by each of the hall sensors 10*ah*, 10*bh*, and 10*ch* is input to the control device 12, and operation of each of the motors 10*am*, 10*bm*, and 10*cm* is controlled by the control device 12. The control device 12 can calculate an angle of the first bottom 3*a* to the second frame 2*b*, an angle of the third bottom 3*c* to the second frame 2*b*, and a height from the floor surface 95 to an upper surface of the second frame 2*b* (bed height L). Specifically, an arithmetic unit 96 of the control device 12 geometrically calculates by using advance lengths of respective piston rods of the actuators 10*a*, 10*b*, and 10*c*, and respective length of the link mechanism 11*a*, 11*b*, 11*c*, so that these numeral values can be calculated.

Figure 10:
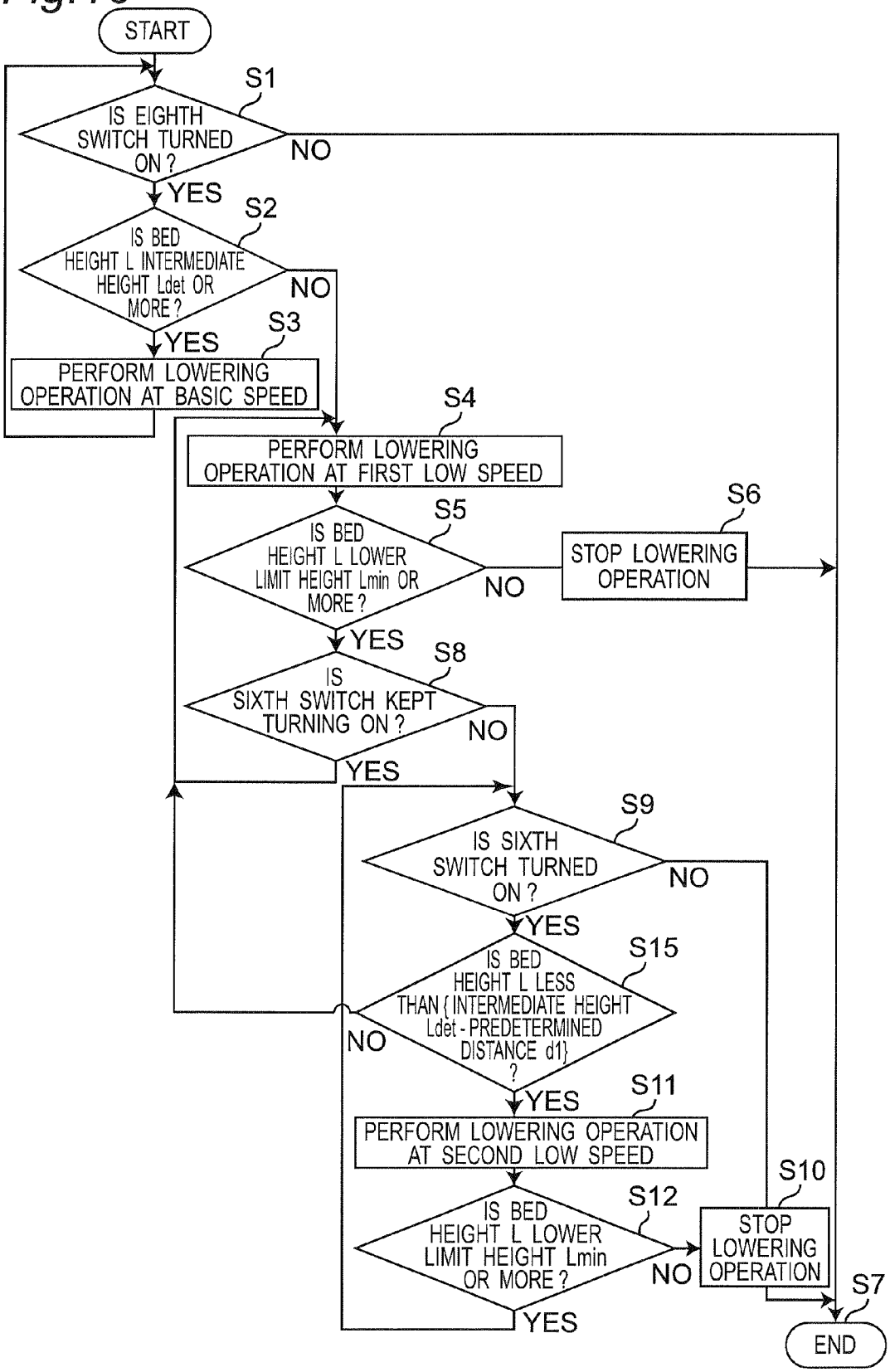
FIG. 10 is a flowchart showing fifth lowering operation in the second embodiment.

As shown in FIG. 10, the second driver 4*a*, the third driver 4*b*, and the first driver 4*c* can independently be manipulated by pressing of independent switches (a third switch 13*a*, a fourth switch 13*b*, a fifth switch 13*c*, a sixth switch 13*d*, a seventh switch 13*e*, and an eighth switch 13*f*) provided in the remote controller 13. Specifically, back lifting-up operation of the first bottom 3*a* can be performed by depression of a back lifting-up switch that is an example of the third switch 13*a*, and back lifting-down operation of the first bottom 3*a* can be performed by depression of a back lifting-down switch that is an example of the fourth switch 13*b*. Additionally, knee lifting-up operation of the third bottom 3*c*, and operation of the fourth bottom 3*d* in cooperation with this knee lifting-up operation can be performed by depression of a knee lifting-up switch that is an example of the fifth switch 13*c*, and knee lifting-down operation of the third bottom 3*c*, and operation of the fourth bottom 3*d* in cooperation with this knee lifting-down operation can be performed by depression of a knee lifting-down switch that is an example of the sixth switch 13*d*. Additionally, rising operation of the second frame 2*b* can be performed by depression of a rising switch that is an example of the seventh switch 13*e*, and lowering operation of the second frame 2*b* can be performed by depression of a lowering switch that is an example of the eighth switch 13*f*. Thus, a manipulator can independently perform the back lifting-up or the back lifting-down operation, the knee lifting-up or the knee lifting-down operation, and the rising and lowering operation as a manipulator's intention by using the remote controller 13, The control device 12 of the bed 1 includes the arithmetic unit 96, a first decision unit 97, a second decision unit 98, and a storage 99. The first decision unit 97 is, for example, a lowering decision unit that detects lowering operation of the bed. The second decision unit 98 is, for example, a height decision unit that compares the bed height L with a reference value and makes a decision.

The first decision unit 97 decides whether or not the eighth switch 13*f* of the remote controller 13 is turned on (is depressed), and outputs a decision result.

The second decision unit 98 compares the bed height L detected by the hall sensor 10*ch* that is an example of a height detection unit mounted on the motor 10*cm* with an intermediate height Ldet or a lower limit height Lmin that is stored, and outputs a comparison result.

The storage 99 stores predetermined values used by the second decision unit 98 and the like (such as the intermediate height Ldet, and the lower limit height Lmin).

The control device 12 controls each operation of the bed 1. Specifically, the control device 12 controls of drive of each of the drivers 4*a*, 4*b*, and 4*c* on the basis of an input instruction from the remote controller 13, and controls drive of the first driver 4*c* based on an input instruction from the remote controller 13, output information from the first decision unit 97, output information from the second decision unit 98, and the like.

Figure 3:
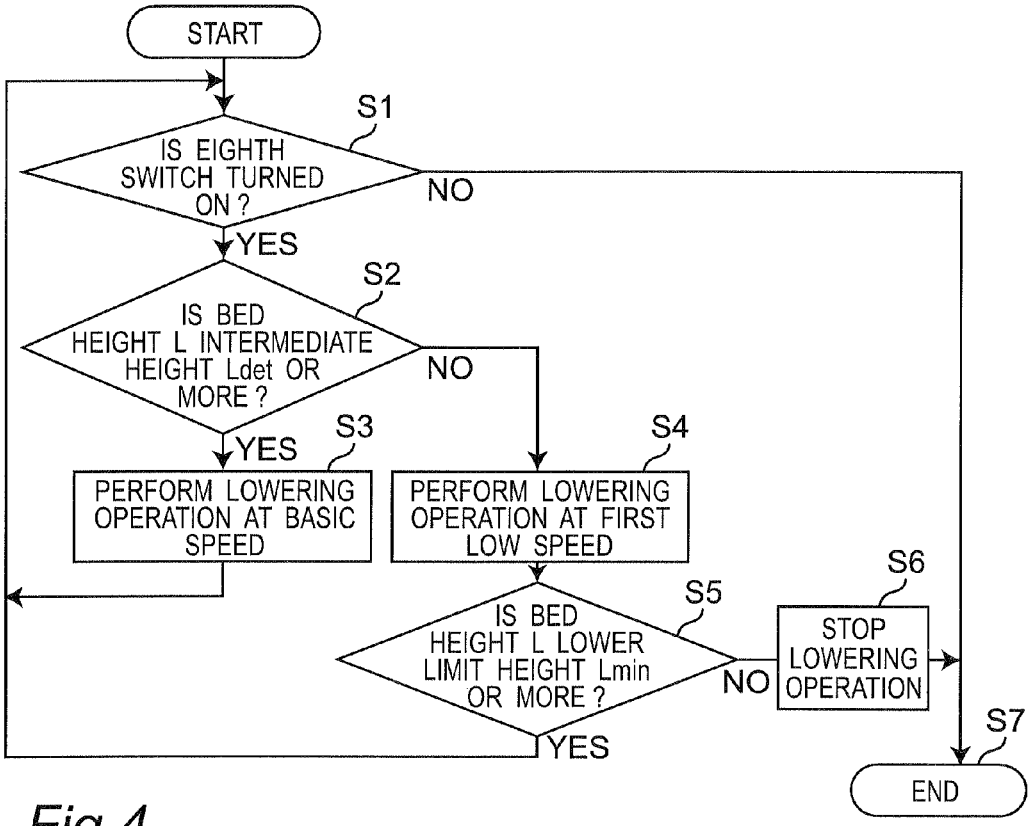
FIG. 3 is a flowchart showing first lowering operation in the first embodiment.
Figure 4:
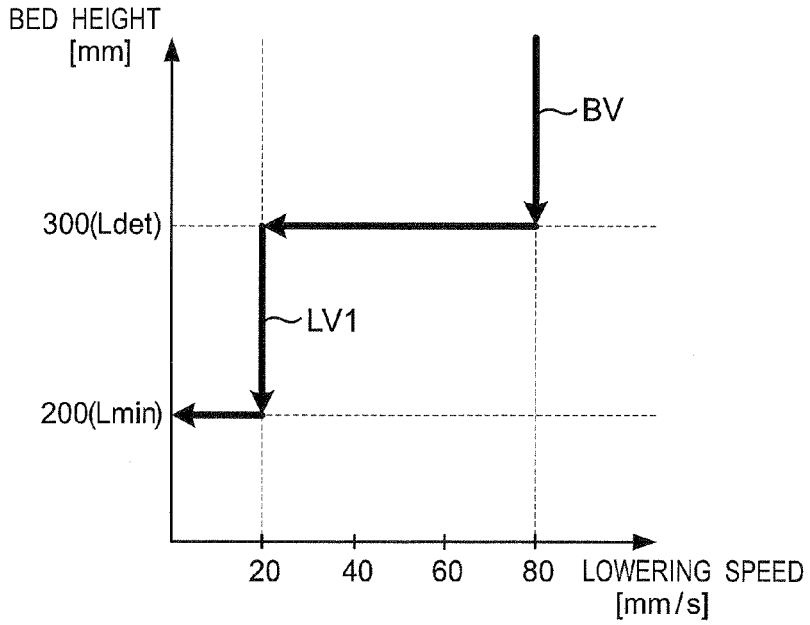
FIG. 4 is a control mode view showing speed change of the first lowering operation in the first embodiment.

Now, operation of the bed 1 composed as described above is described. FIG. 3 is a flowchart showing each operation of the bed 1 of the first embodiment. FIG. 4 is a control mode view showing speed change of lowering operation in accordance with a height of the second frame 2*b*.

Herein, a height when the second frame 2*b* rises most is defined as an upper limit height Lmax (e.g., 700 mm), and a position when the second frame 2*b* lowers most is defined as the lower limit height Lmin (e.g., 200 mm). In the first embodiment, the bed height L is defined as the intermediate height Ldet (e.g., 300 mm). There is a possibility of sandwiching a foot or the like of a caregiver or a care receiver at the bed height L in the first embodiment, and the bed height Lisa height of the bed, for which attention to sandwiching should be paid. The intermediate height Ldet is set between the upper limit height Lmax and the lower limit height Lmin. The seventh switch 13*e* or the eighth switch 13*f* of the remote controller 13 is depressed, so that the second frame 2*b* of the bed 1 performs rising and lowering operation (vertical moving-up-and-down operation) between the upper limit height Lmax and the lower limit height Lmin. The intermediate height Ldet is an example of a first predetermined height of the second frame 2*b* that is a reference of switching a lowering speed of the second frame 2*b*.

First lowering operation of the bed 1 of the first embodiment is described with reference to the flowchart shown in FIG. 3.

First, the control device 12 causes the first decision unit 97 to decide whether or not the eighth switch 13*f* of the remote controller 13 is turned on (depressed) (Step S1). When the first decision unit 97 decides that the eighth switch 13*f* is turned off in Step S1 (No in Step S1), the flow of the first lowering operation is ended (Step S7). When the first decision unit 97 decides that the eighth switch 13*f* is turned on in Step S1 (Yes in Step S1), the process proceeds to Step S2.

In Step S2, the second decision unit 98 decides whether or not a bed height L calculated by the arithmetic unit 96 is the intermediate height Ldet or more.

When the second decision unit 98 decides that the bed height L is the intermediate height Ldet or more in Step S2 (Yes in Step S2), the process proceeds to Step S3. In Step S3, the first driver 4*c* is driven under control of the control device 12 to perform lowering operation of the second frame 2*b* at a basic speed BV (e.g., 80 mm/s) that is a normal lowering speed. Thereafter, the process returns to Step S1.

On the other hand, when the second decision unit 98 decides that the bed height L is less than the intermediate height Ldet in Step S2 (No in Step S2), the process proceeds to Step S4.

In Step S4, the first driver 4*c* is driven under control of the control device 12 to perform lowering operation of the second frame 2*b* at a first low speed LV1 (e.g., 20 mm/s) that is a lowering speed slower than the basic speed BV as shown in FIG. 4. Thereafter, the process proceeds to Step S5. As described later, in order to make a manipulator to visually find and notice that the lowering operation become slow, the first low speed LV1 is set to at least a half or less of the basic speed BV as an example. The basic speed BV and the first low speed LV1 are stored in the storage 99.

In Step S5, the second decision unit 98 decides whether or not the bed height L is the lower limit height Lmin or more. When the second decision unit 98 decides that the bed height L is less than the lower limit height Lmin in Step S5 (No in Step S5), the process proceeds to Step S6. In Step S6, the drive of the first driver 4*c* is stopped under control of the control device 12, and the lowering operation of the second frame 2*b* is ended (Step S7).

On the other hand, when the second decision unit 98 decides that the bed height L is the lower limit height Lmin or more in Step S5 (Yes in Step S5), the process returns to Step S1.

That is, in the first lowering operation of the bed 1 of the first embodiment shown in FIG. 3 and FIG. 4, in a case where the second decision unit 98 decides that the bed height L is less than the intermediate height Ldet, a possibility of sandwiching a foot or the like of a caregiver or a care receiver is caused. Therefore, the control device 12 controls the drive of the first driver 4*c*, to reduce the lowering speed of the whole of the bed from the basic speed BV to the first low speed LV1, as shown in FIG. 4. Thus, by the control of the control device 12, the manipulator of the bed 1 such as a caregiver or the like can be made to visually find and notice that the lowering operation become slow, and manipulator's attention to sandwiching can be invited. On the other hand, a care receiver can feel that the lowering operation become slow, and care receiver's attention to sandwiching can be invited.

In the first lowering operation of the first embodiment, also in a case where manipulation such as press and release of the eighth switch 13*f* is repeated, and the whole of the bed is lowered little by little, when the second decision unit 98 decides that the bed height L is less than the intermediate height Ldet, the second frame is lowered at the first low speed LV1 slower than the basic speed BV. Therefore, also in a case where the whole of the bed is lowered little by little, a risk of sandwiching is warned and a possibility of sandwiching is reduced. Additionally, influence in a case of sandwiching by any chance can be reduced.

In the first lowering operation of the first embodiment, also in a case where the eighth switch 13*f* is continued to be pressed, and the bed height L becomes less than the intermediate height Ldet, the operation is not stopped, and the lowering operation is continued at the first low speed LV1 slower than the basic speed BV at the bed height less than the intermediate height Ldet, at which there is a risk of sandwiching. Therefore, even when a manipulator unfamiliar to manipulation manipulates, the manipulator can safely perform manipulation without feeling anxious about the manipulation.

The first embodiment is particularly effective when warn sound such as a buzzer is set to a quiet mode at night or the like.

Modification of First Embodiment

Figure 5:
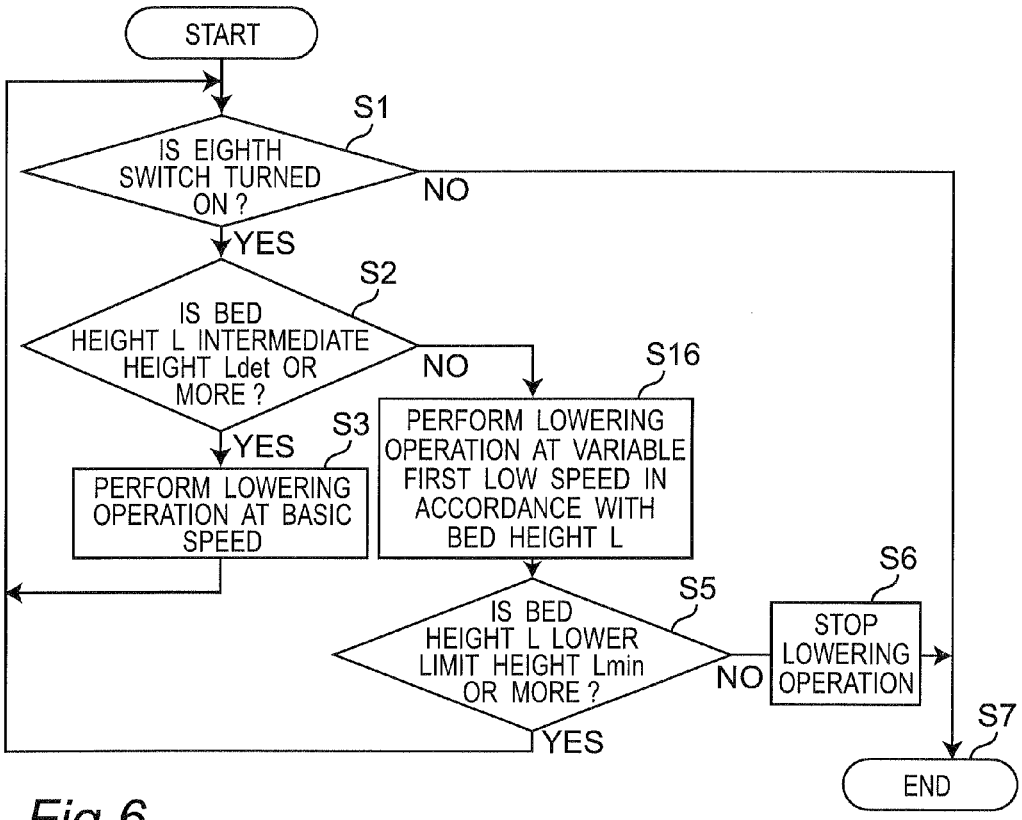
FIG. 5 is a flowchart showing second lowering operation in the first embodiment.
Figure 6:
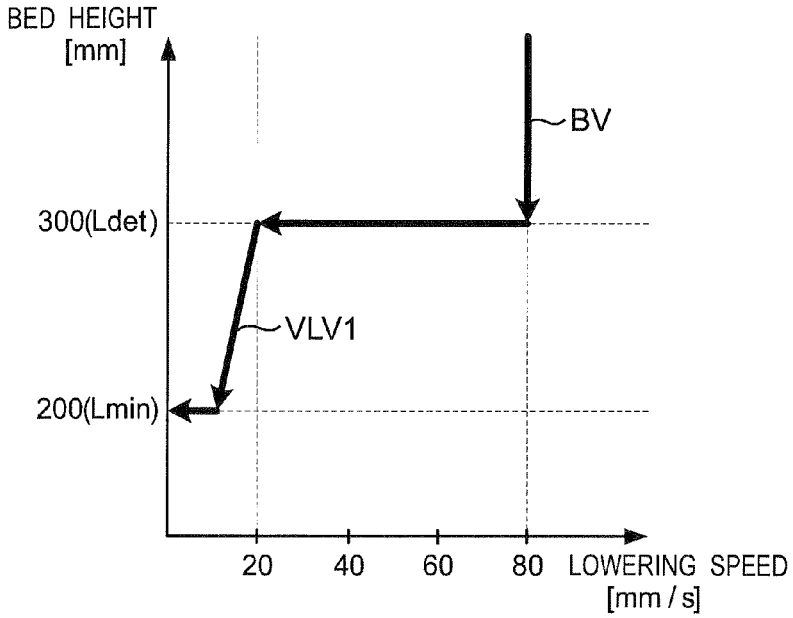
FIG. 6 is a control mode view showing speed change of the second lowering operation in the first embodiment.

FIG. 5 is a flowchart showing second lowering operation of a modification of the first embodiment. FIG. 6 is a control mode view of speed change of the second lowering operation.

In the modification of the first embodiment, the second lowering operation is performed in place of the lowering operation of the second frame 2*b* at the first low speed LV1 in Step S4 of FIG. 3, as shown in FIG. 5 and FIG. 6. In the second lowering operation, a first driver 4*c* is driven under control of a control device 12, and lowering operation is performed at a variable first low speed VLV1 in accordance with a bed height L (Step S16). Thus, the second lowering operation is performed, so that it is possible to reduce a possibility of sandwiching and to enhance safety.

The variable first low speed VLV1 is a speed that varies in accordance with the bed height L, and is stored in a storage 99. The variable first low speed VLV1 is specifically stored as a relational expression, a table, or a graph with the bed height L in the storage 99. The bed height L and the variable first low speed VLV1 are associated such that the smaller the bed height L is, the slower the variable first low speed VLV1 is, for example.

With such a configuration, in the modification of the first embodiment, as the second frame 2*b* approaches a floor surface 95, the lowering speed of the second frame 2*b* can be made to be slower. Additionally it is possible to further reduce a possibility of sandwiching although convenience of the lowering operation of the bed 1 is degraded.

The modification of the first embodiment is similar to the first embodiment except that the process in Step S16 is performed in place of the process in Step S4 of FIG. 3, and therefore description is appropriately omitted.

Second Embodiment

Figure 7:
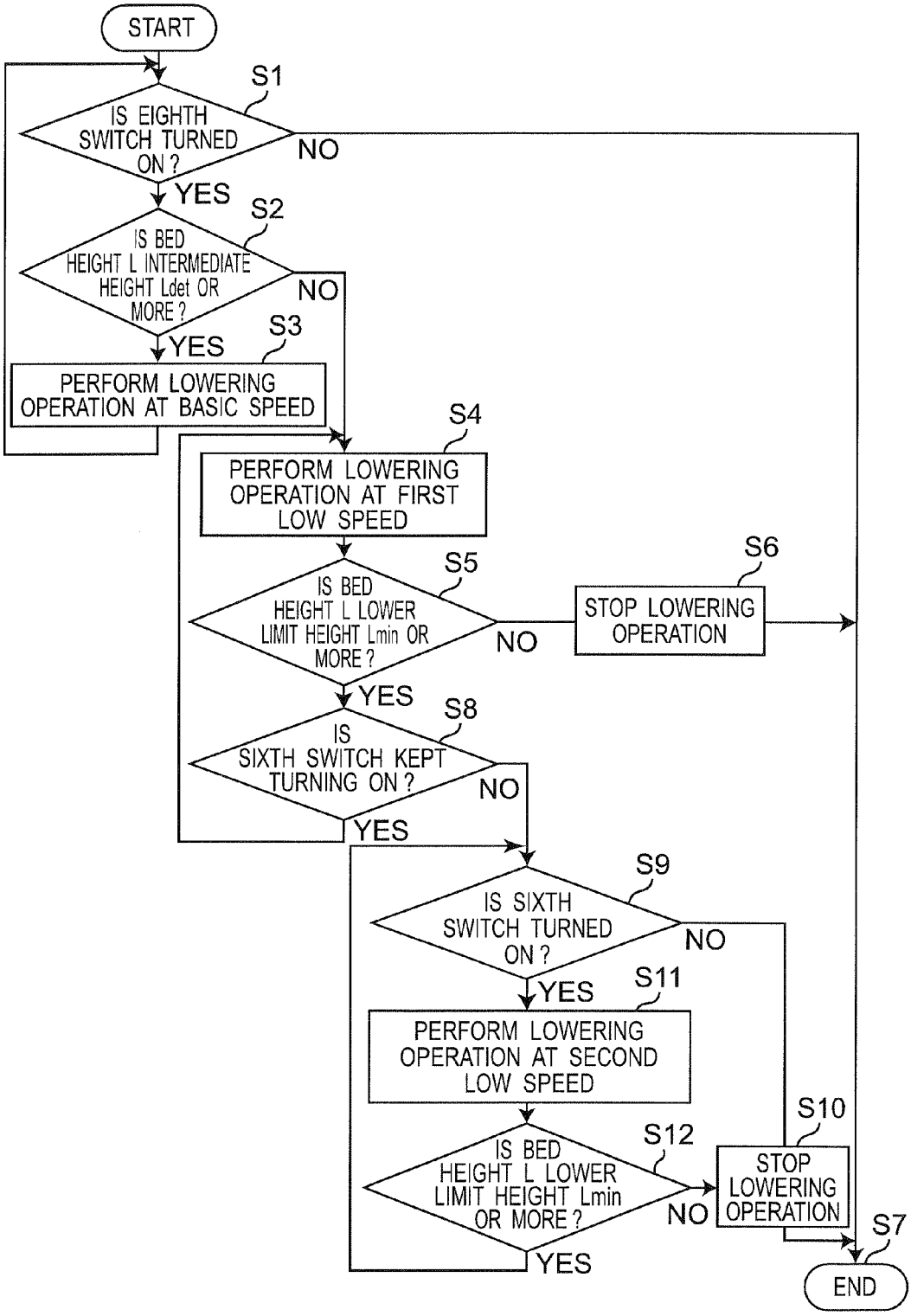
FIG. 7 is a flowchart showing third lowering operation in a second embodiment of the present invention.
Figure 8:
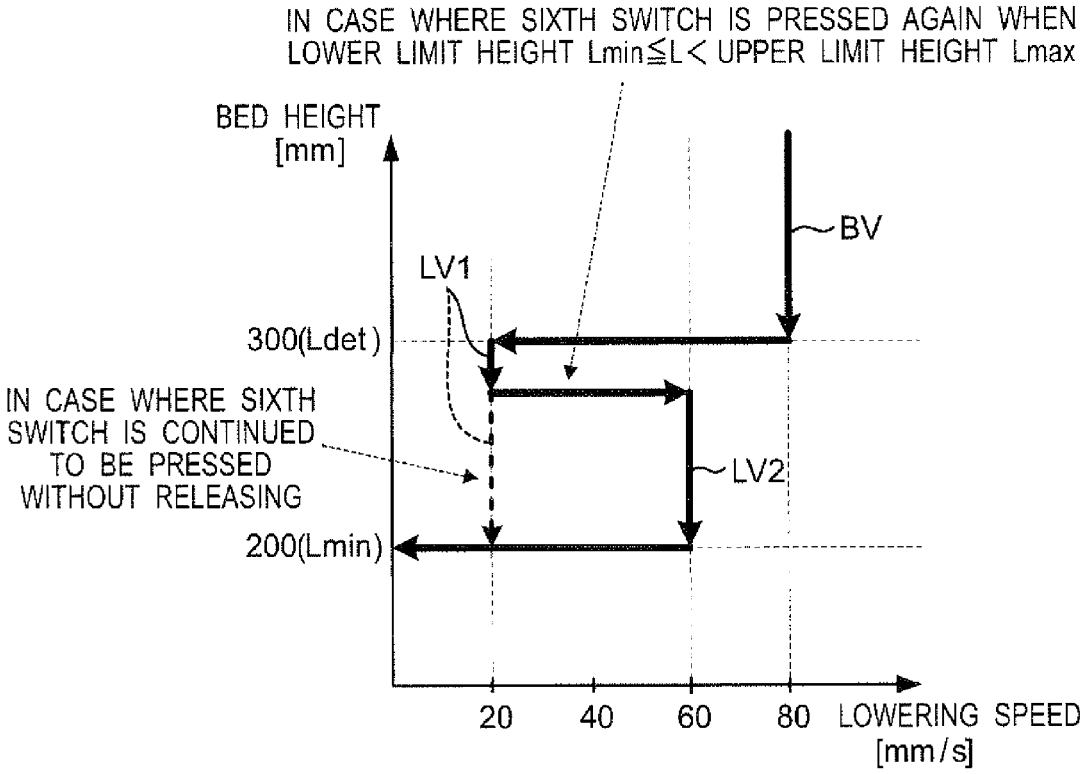
FIG. 8 is a control mode view showing speed change of the third lowering operation in the second embodiment.

FIG. 7 is a flowchart showing third lowering operation of a second embodiment of the present invention. FIG. 8 is a control mode view showing speed change of the third lowering operation. A configuration of a bed 1 of the second embodiment is similar to the aforementioned first embodiment, and therefore description is appropriately omitted.

With reference to the flowchart shown in FIG. 7, the third lowering operation of the bed 1 of the second embodiment is described.

First, a first decision unit 97 decides whether or not an eighth switch 13*f* of a remote controller 13 is turned on (depressed) (Step S1). When the first decision unit 97 decides that the eighth switch 13*f* is turned off in Step S1 (No in Step S1), the flow of the third lowering operation is ended (Step 37). When the first decision unit 97 decides that the eighth switch 13*f* is turned on in Step S1 (Yes in Step S1), the process proceeds to Step S2. In Step S2, a second decision unit 98 decides whether or not a bed height L calculated by an arithmetic unit 96 is an intermediate height Ldet or more.

When the second decision unit 98 decides that the bed height L is the intermediate height Ldet or more in Step S2 (Yes in Step S2), the process proceeds to Step S3. In Step S3, a first driver 4*c* is driven under control of a control device 12 to perform lowering operation of a second frame 2*b* at a basic speed BV that is a normal lowering speed. Thereafter, the process returns to Step S1.

On the other hand, when the second decision unit 98 decides that the bed height L is less than the intermediate height Ldet in Step S2 (No in Step S2), the process proceeds to Step S4. In Step S4, the first driver 4*c* is driven under control of the control device 12 to perform lowering operation of the second frame 2*b* at a first low speed LV1 that is a lowering speed slower than the basic speed BV as shown in FIG. 8. Thereafter, the process proceeds to Step S5.

In Step S5, the second decision unit 98 further decides whether or not the bed height L is a lower limit height Lmin or more. When the second decision unit 98 decides that the bed height L is less than the lower limit height Lmin in Step S5 (No in Step S5), the process proceeds to Step S6. In Step S6, the drive of the first driver 4*c* is stopped under control of the control device 12, and the lowering operation of the second frame 2*b* is ended (Step S7).

On the other hand, when the second decision unit 98 decides that the bed height L is the lower limit height Lmin or more in Step S5 (Yes in Step S5), the process proceeds to Step S8. In Step S8, the first decision unit 97 decides whether or not the eighth switch 13*f* is kept turning on. When the first decision unit 97 decides that the eighth switch 13*f* is kept turning on (Yes in Step S8), the process returns to Step S4, lowering operation is performed at the first low speed LV1. When the first decision unit 97 decides that the eighth switch 13*f* is turned off once in Step S8 (No in Step S8), the process proceeds to Step S9.

In Step S9, the first decision unit 97 decides whether or not the eighth switch 13*f* is turned on (depressed) again. When the first decision unit 97 decides that the eighth switch 13*f* is not turned on in Step S9 (No in Step S9), the process proceeds to Step S10. In Step S10, the drive of the first driver 4*c* is stopped under control of the control device 12, the lowering operation of the second frame 2*b* is stopped. Alternatively, the stop of the drive of the first driver 4*c* is maintained under control of the control device 12 to continue the stop of the lowering operation, and the lowering operation of the second frame 2*b* is ended (Step S7).

On the other hand, when the first decision unit 97 decides that the eighth switch 13*f* is turned on in Step S9 (Yes in Step S9), the process proceeds to Step S11.

In Step S11, the first driver 4*c* is driven under control of the control device 12 to accelerate the operation to a second low speed LV2 (e.g., 60 mm/s) faster than the first low speed LV1 and slower than the basic speed By, and to perform the lowering operation of the second frame 2*b*, as shown in FIG. 8. Thereafter, the process proceeds to Step S12.

In Step S12, the second decision unit 98 decides whether or not the bed height L is the lower limit height Lmin or more. When the second decision unit 98 decides that the bed height L is less than the lower limit height Lmin in Step S12 (No in Step S12), the process proceeds to Step S10. In Step S10, the drive of the first driver 4*c* is stopped under control of the control device 12, and the lowering operation of the second frame 2*b* is ended (Step S7), as described above. On the other hand, when the second decision unit 98 decides that the bed height L is the lower limit height Lmin or more in Step S12 (Yes in Step S12), the process returns to Step S9.

That is, in the third lowering operation of the second embodiment, acceleration of the lowering operation is possible only when a manipulator intentionally presses the eighth switch 13*f* again even at a bed height having a risk of sandwiching (lower limit height Lmin≤bed height L<intermediate height Ldet). Therefore, the second embodiment is effective in a case where the manipulator recognizes the risk of sandwiching and enhances efficiency of caring work or the like. However, since there is the risk of sandwiching, in the second embodiment, safety is improved by making the lowering speed become slower than the basic speed BV, and the lowering operation is performed at the second low speed LV2 that is a lowering speed faster than the first low speed LV1, so that operability is improved.

First Modification of Second Embodiment

Figure 9:
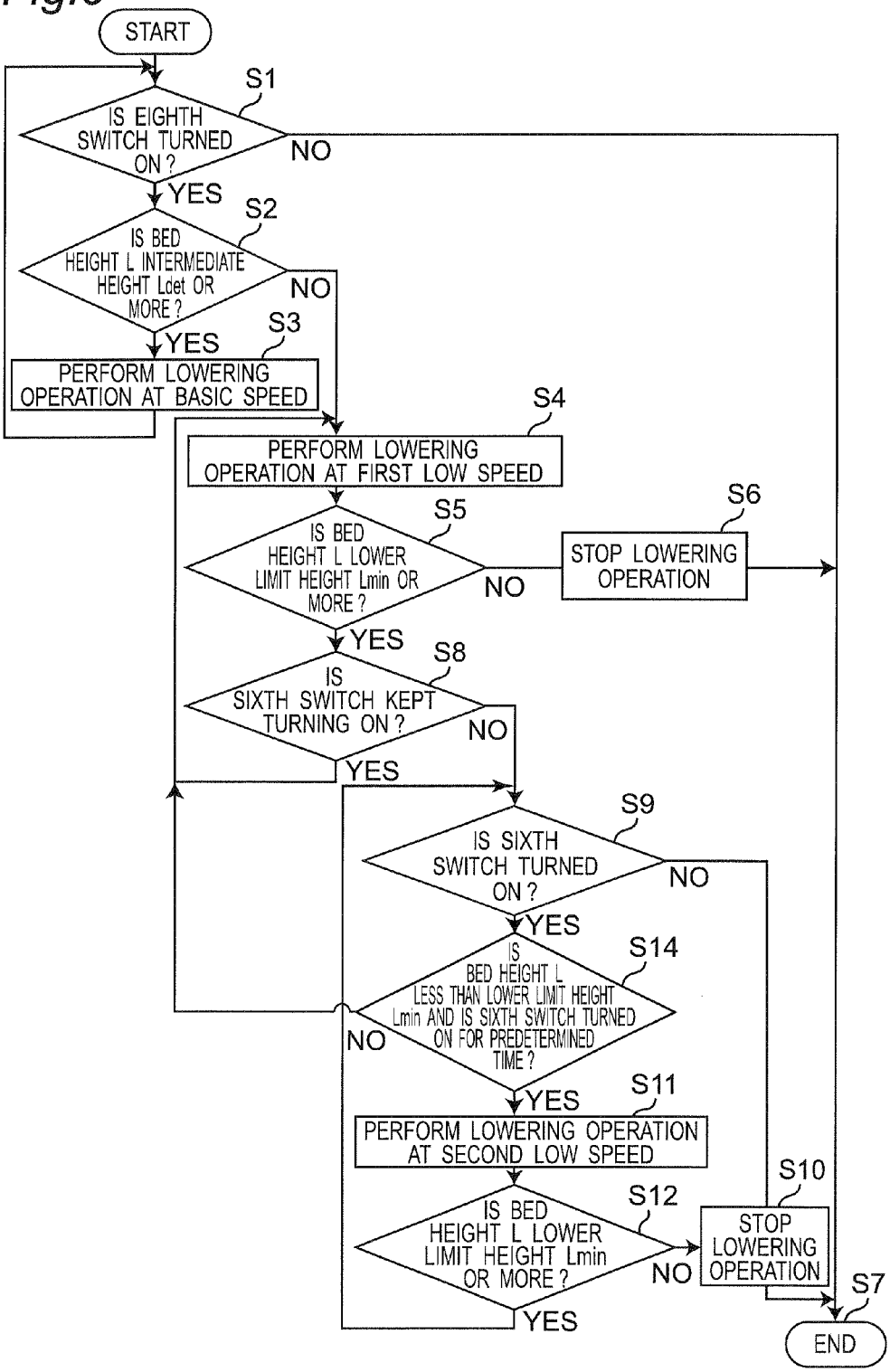
FIG. 9 is a flowchart showing fourth lowering operation in the second embodiment.

FIG. 9 is a flowchart showing fourth lowering operation according to a first modification of the second embodiment. In the first modification of the second embodiment, Step S14 is added after Step S9 and before Step S11, as shown in FIG. 9. Only in a case where a first decision unit 97 decides that operation is performed at a first low speed LV1 for a predetermined time (e.g., 1 second) or more in Step S14, (Yes in Step S14), the lowering operation is accelerated to a second low speed LV2. That is, in a case where the first decision unit 97 decides that depression of an eighth switch 13*f* is released after a time that is less than the predetermined time (No in Step S14), the process returns to Step S4, and the lowering operation is performed at the first low speed LV1 even when the eighth switch 13*f* is pressed again. On the other hand, in a case where the first decision unit 97 decides that the depression of an eighth switch 13*f* is released after the predetermined time or more (Yes in Step S14), that is, in a case where the first decision unit 97 decides that the eighth switch 13*f* is pressed and the lowering operation is continued at the first low speed LV1 for the predetermined time or more, the lowering operation is accelerated to the second low speed LV2.

Consequently, it is possible to prevent the lowering operation from accelerating from the first low speed LV1 to the second low speed LV2 without recognition of the risk of sandwiching by a manipulator due to unintentional press of the eighth switch 13*f* again by the manipulator right after the bed height L becomes less than the intermediate height Ldet (right after Step S9). Thus, the lowering speed is not accelerated for the predetermined time after the speed is reduced at the intermediate height Ldet, so that it is possible to further reduce the possibility of sandwiching to enhance safety.

The first modification of the second embodiment is similar to the second embodiment except that Step S14 is added after Step S9 of FIG. 7, and therefore description is appropriately omitted.

Second Modification of Second Embodiment

FIG. 10 is a flowchart showing fifth lowering operation according to a second modification of the second embodiment. In the second modification of the second embodiment, Step S15 is added after Step S9 and before Step S11, as shown in FIG. 10. In Step S15, in a case where it is decided that lowering operation is performed at an intermediate height Ldet by a predetermined distance d1 (e.g., 20 mm), the lowering operation is accelerated to a second low speed LV2. That is, in Step S15, a second decision unit 98 decides whether or not a bed height L is less than [intermediate height Ldet−predetermined distance d1], and decides that the bed height L is less than [intermediate height Ldet−predetermined distance d1] (Yes in Step S15), a first driver 4*c* is driven under control of a control device 12, to accelerates the lowering operation from a first low speed LV1 to the second low speed LV2. Thus, the lowering speed is reduced at the intermediate height Ldet, and thereafter the lowering operation is not accelerated for the predetermined distance, so that it is possible to further reduce a possibility of sandwiching to enhance safety. In a case where the second decision unit 98 decides No in Step S15, the process returns to Step S4.

The second modification of the second embodiment is similar to the second embodiment except that Step S15 is added after Step S9 in FIG. 7, and therefore description is appropriately omitted.

Third Modification of Second Embodiment

Figure 11:
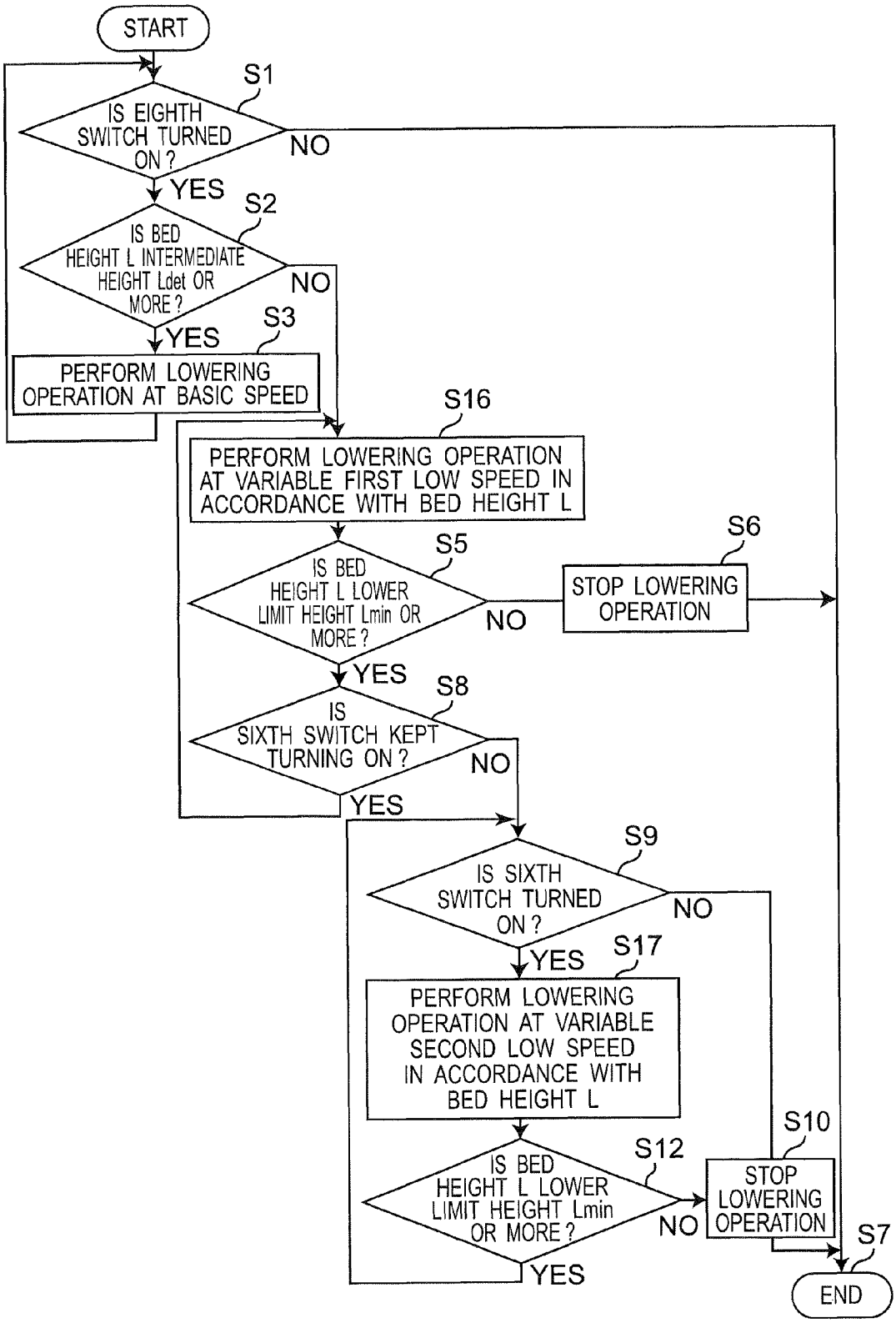
FIG. 11 is a flowchart showing sixth lowering operation in the second embodiment.
Figure 12:
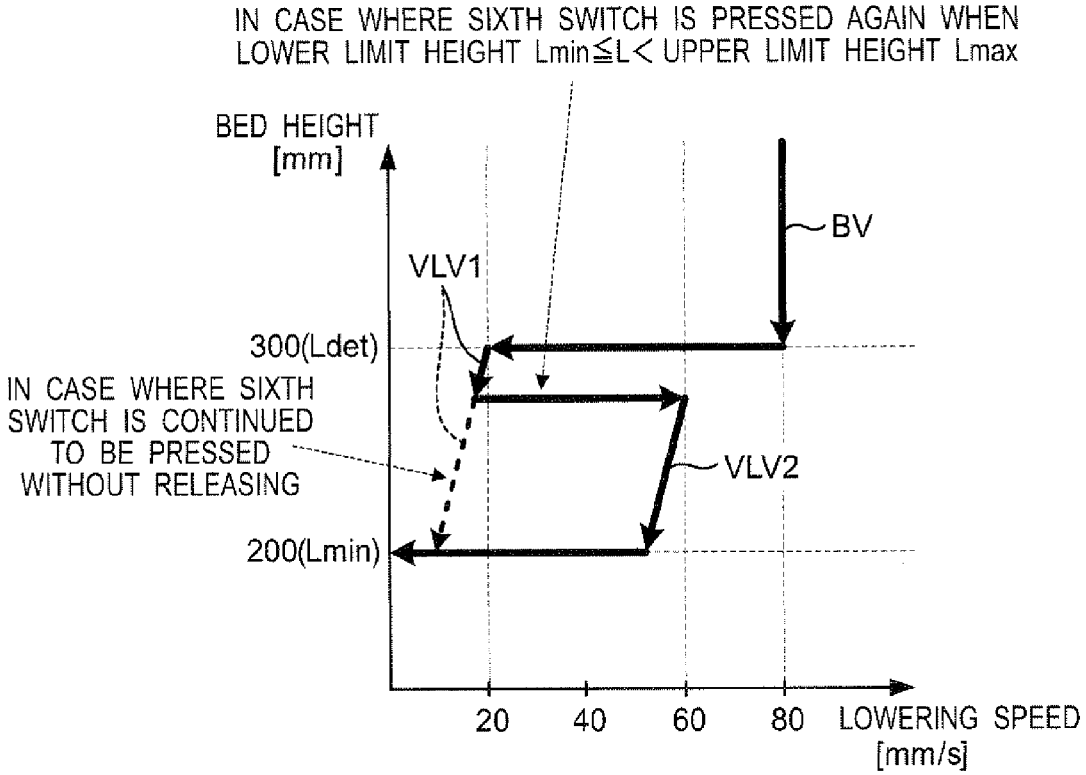
FIG. 12 is a control mode view showing speed change of the sixth lowering operation in the second embodiment.

FIG. 11 is a flowchart showing sixth lowering operation according to a third modification of the second embodiment. FIG. 12 is a control mode view of speed change of the sixth lowering operation.

In the third modification of the second embodiment, in order to further reduce a possibility of sandwiching to enhance safety, lowering operation of a second frame 2*b* is performed at a variable first low speed VLV1 (Step S16) and a variable second low speed VLV2 (Step S17) such that as a bed height L reduces, the lowering speed becomes slow, as shown in FIG. 11 and FIG. 12. The variable second low speed VLV2 is a lowering speed that is faster than the variable first low speed VLV1 and is slower than a basic speed BV. The variable second low speed VLV2 is expressed by a relational expression, a table, or a graph with the bed height L, and is stored in a storage 99. The bed height L and the variable second low speed VLV2 are associated such that the smaller the bed height L is, the slower the variable second low speed VLV2 is, for example. A control device 12 reads the variable second low speed VLV2 from the storage 99 based on the bed height L1 calculated by an arithmetic unit 96, and controls drive of a first driver 4*c*.

Any one of Step S16 and Step S17 is replaced by Step S4 or Step S11 shown in FIG. 7, so that any one of the variable low speeds may be employed.

With such a configuration, as the bed height 1, reduces, the lowering speed can be made to be slower, a caregiver or a care receiver notices the risk, and a possibility of avoiding sandwiching can be further enhanced.

The third modification of the second embodiment is similar to the second embodiment except that the process in Step S16 is performed in place of the process of Step S4 of FIG. 7, and the process in Step S17 is performed in place of the process of Step S11, and therefore description is appropriately omitted.

Fourth Modification of Second Embodiment

Figure 13:
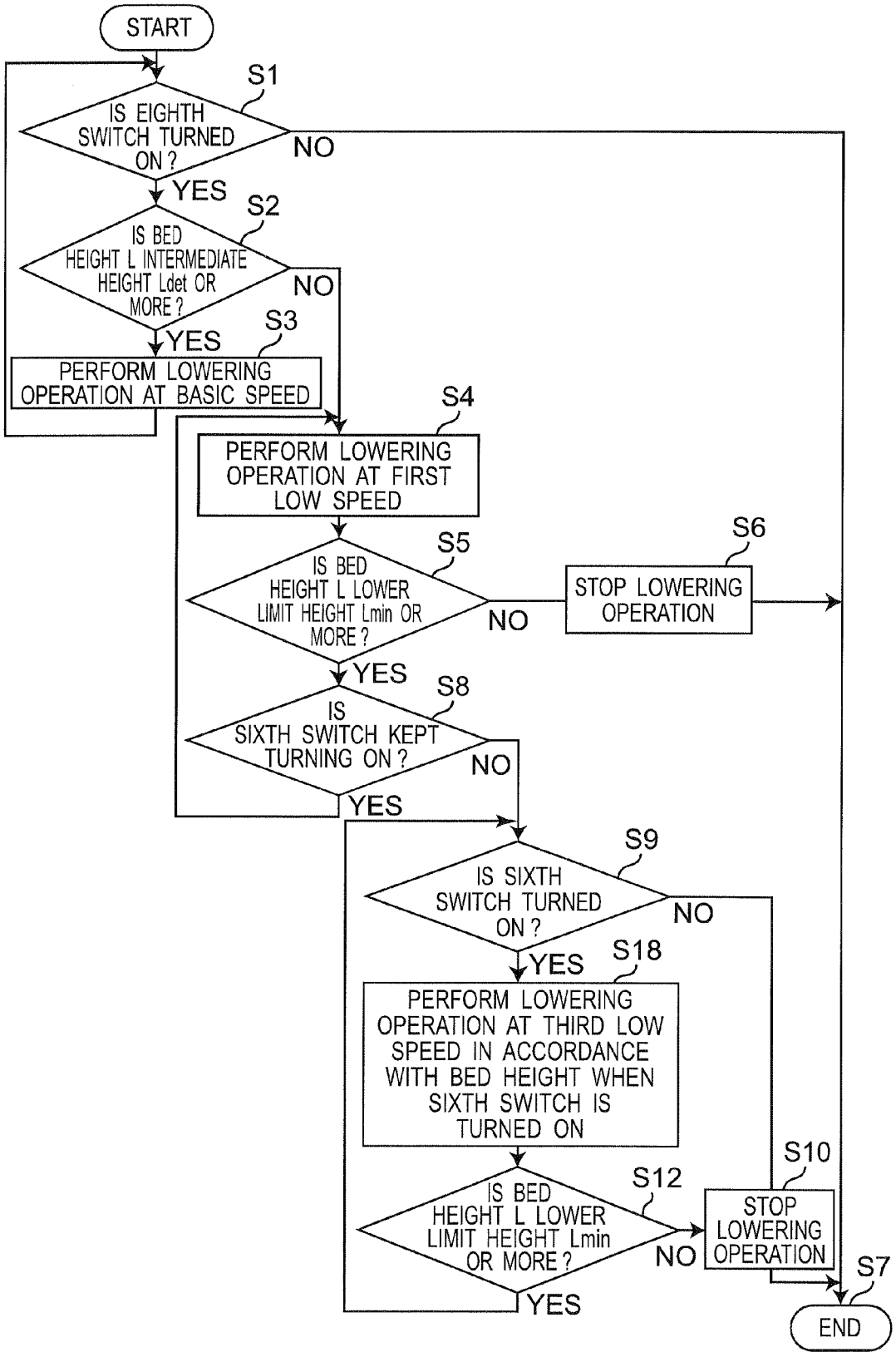
FIG. 13 is a flowchart showing seventh lowering operation in the second embodiment.
Figure 14:
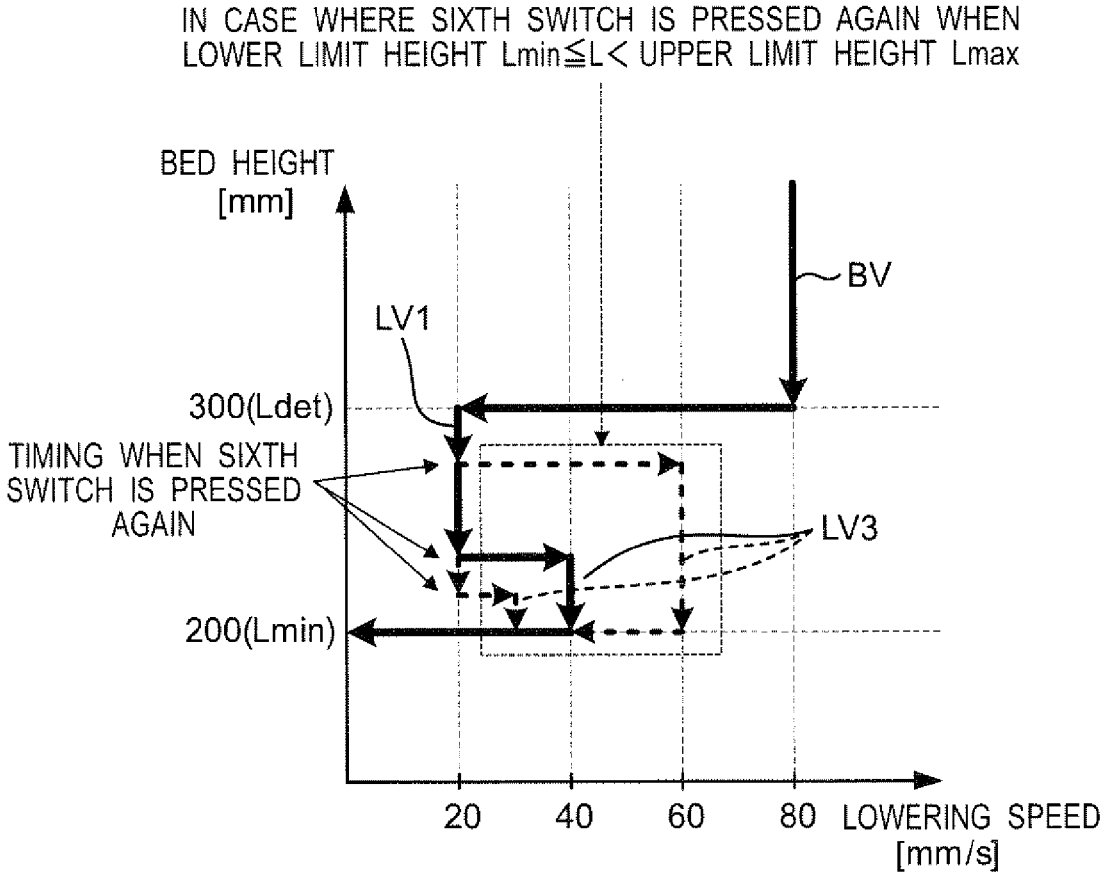
FIG. 14 is a control mode view showing speed change of the seventh lowering operation in the second embodiment.

FIG. 13 is a flowchart showing seventh lowering operation according to a fourth modification of the second embodiment, and FIG. 14 is a control mode view of speed change of the seventh lowering operation.

In the fourth modification of the second embodiment, Step S11 of FIG. 7 is replaced by Step S18. In Step S18, when an eighth switch 13*f* is pressed again during lowering operation at a first low speed LV1, the lowering operation is accelerated to a third low speed LV3, as shown in FIG. 13 and FIG. 14. The third low speed LV3 is a speed that becomes slower in accordance with a bed height L as the bed height L reduces, as shown in FIG. 14. Thus, in a case where the bed height L is a lower limit height Lmin at which there is a large clearance with a floor surface 95 (Yes in Step S5) or more, and an eighth switch 13*f* is being turned on (Yes in Step S8), lowering operation is continued to be performed at the first low speed LV1 with no change. On the other hand, only in a case where the eighth switch 13*f* is turned off once, and is turned on again (No in Step S8 and Yes in Step S9), a lowering speed is made to be the third low speed LV3 in accordance with a position where the eighth switch 13*f* is turned on again, so that it is possible to reduce a time required for lowering, and to reduce a possibility of sandwiching.

FIG. 14 shows a situation where the third low speed LV3 is set to 40 mm/s that is slower than 60 mm/s, in a case where the bed height L when the eighth switch 13*f* is pressed again is 230 mm.

The fourth modification of the second embodiment is similar to the second embodiment except that the process in Step S18 is performed in place of the process of Step S11 of FIG. 7, and therefore description is appropriately omitted.

Fifth Modification of Second Embodiment

Figure 16:
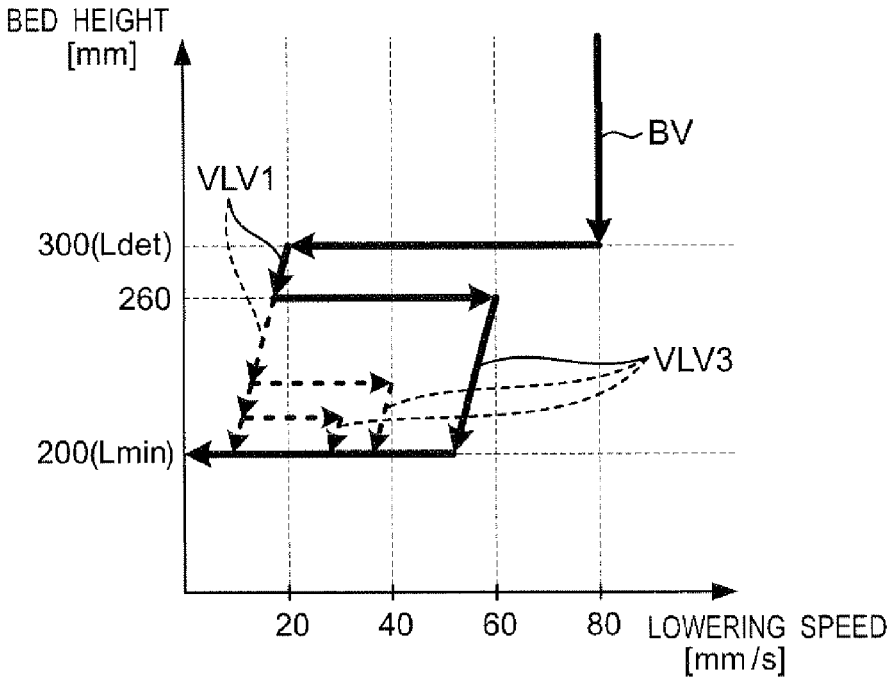
FIG. 16 is a control mode view showing speed change of the eight lowering operation in the second embodiment.

FIG. 15 is a flowchart showing eighth lowering operation according to a fifth modification of the second embodiment. FIG. 16 is a control mode view of speed change of the eighth lowering operation.

In the fifth modification of the second embodiment, Step S17 of FIG. 11 is replaced by Step S18. Accordingly, as shown in FIG. 15 and FIG. 16, when an eighth switch 13*f* is pressed again (No in Step S8 and Yes in Step S9) during lowering operation at a variable first low speed VLV1 in a case where a bed height L is less than an intermediate height Ldet (No in Step S2), a lowering speed is set to a variable third low speed VLV3 in accordance with a position where the eighth switch 13*f* is turned on again (Step S18). The variable third low speed VLV3 is a speed that is slower than a basic speed BV and is faster than a first low speed LV1, and whose initial speed changes in accordance with the bed height L when the eighth switch 13*f* is depressed. Specifically, as shown in FIG. 16, the variable third low speed VLV3 is a variable speed that is accelerated to 60 mm/s, and thereafter reduces in accordance with the bed height L, in a case the eighth switch 13*f* is turned on again at a bed height L of 260 mm, for example. Consequently, it is possible to further enhance operability and safety.

The fifth modification of the second embodiment is similar to the second embodiment except that the process in Step S16 is performed in place of the process in Step S4 of FIG. 7, and the process in Step S18 is performed in place of the process in Step S11, and therefore description is appropriately omitted.

As described above, according to the second embodiment, also in a case where while a caregiver confirms a physical condition of a care receiver, manipulation such as press and release of switches of the remote controller 13 is repeated, and lowering operation is performed little by little, it is possible to reliably warn and prevent a risk of sandwiching by speed reducing operation. Similarly, also in a case where a caregiver unfamiliar to manipulation manipulates when warn sound is set to a quiet mode, lowering operation can be continued as a manipulator's intention, and therefore the manipulator can safely perform manipulation without feeling anxious about the manipulation. That is, it is possible to provide an electric bed capable of preventing sandwiching during lowering operation of the bed, and reducing anxiety about manipulation.

The present invention is not limited to the above embodiments, but can be implemented in other various modes.

Additionally, in each of the above embodiments and modifications, the basic speed By, the first low speed LV1, the second low speed LV2, and the third low speed LV3 each are a constant speed.

Third Embodiment

Figure 17A:
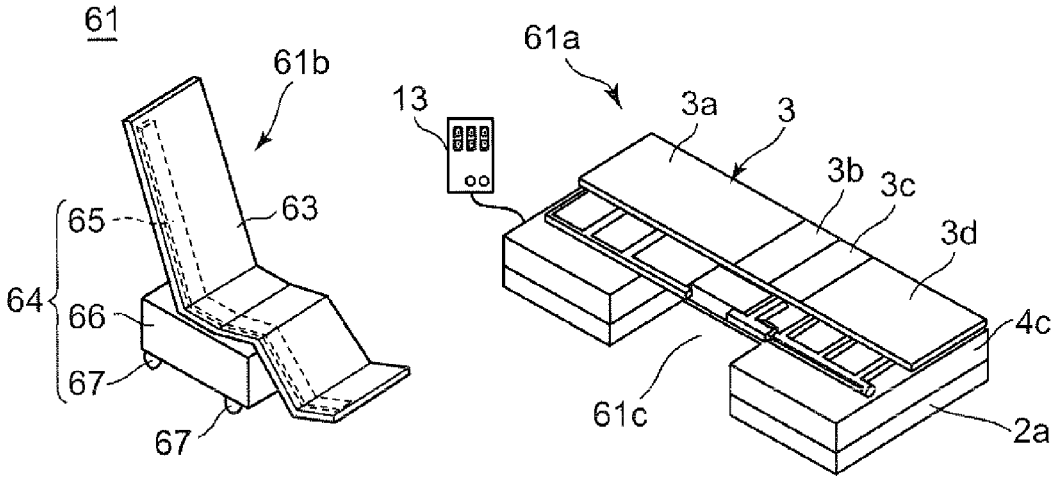
FIG. 17A is a schematic perspective view showing a separated state of a separable bed of a third embodiment of the present invention.
Figure 17B:
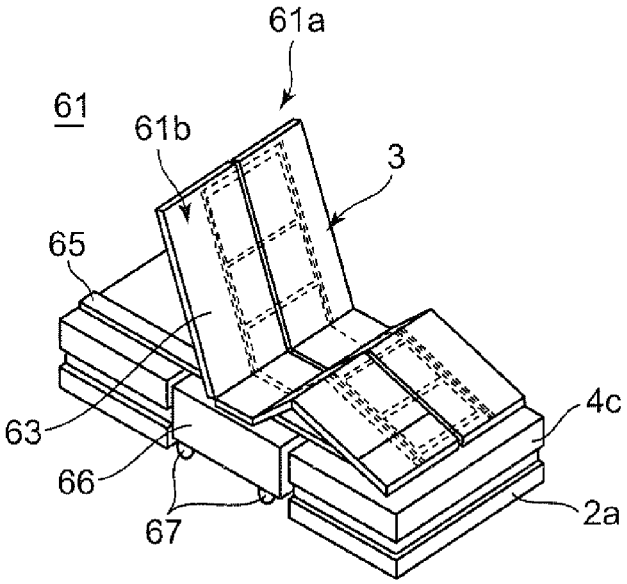
FIG. 17B is a schematic perspective view showing a combined state of the separable bed of the third embodiment of the present invention.
Figure 18A:
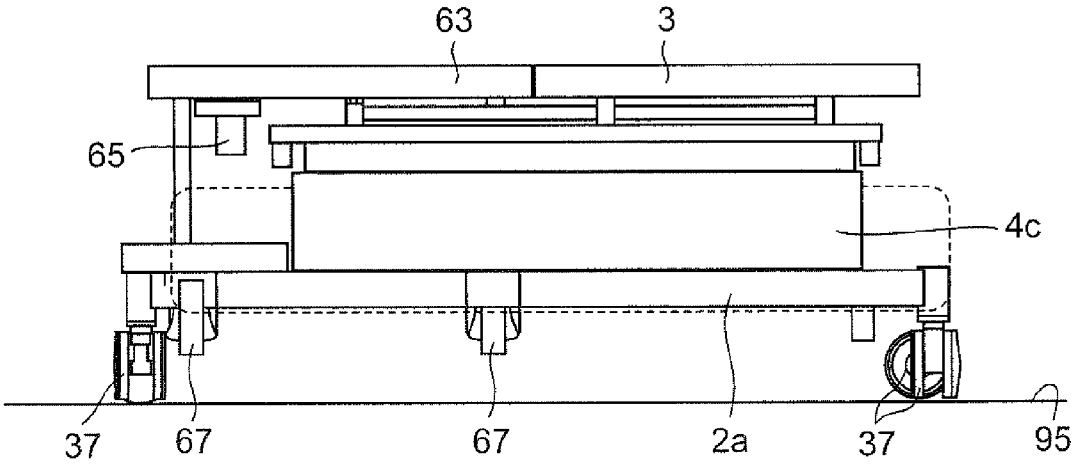
FIG. 18A is a front view of the separable bed in the combined state at start of lowering of an upper frame, in the separable bed of the third embodiment.
Figure 18B:
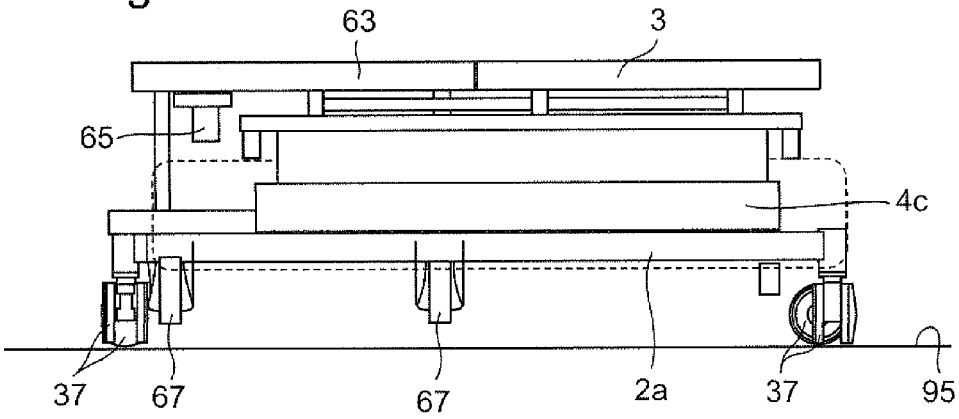
FIG. 18B is a front view of the separable bed in the combined state in the middle of the lowering of the upper frame, in the separable bed of the third embodiment.
Figure 18C:
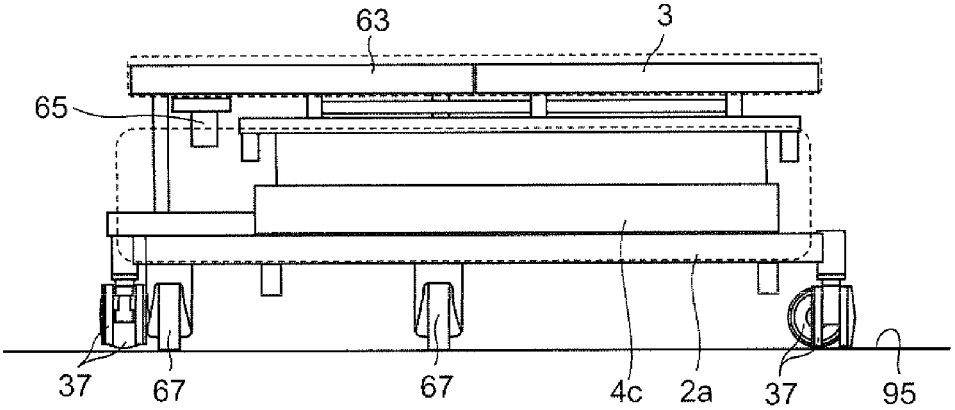
FIG. 18C is a front view of the separable bed in the combined state at a lower limit position of the upper frame, in the third embodiment.
Figure 19A:
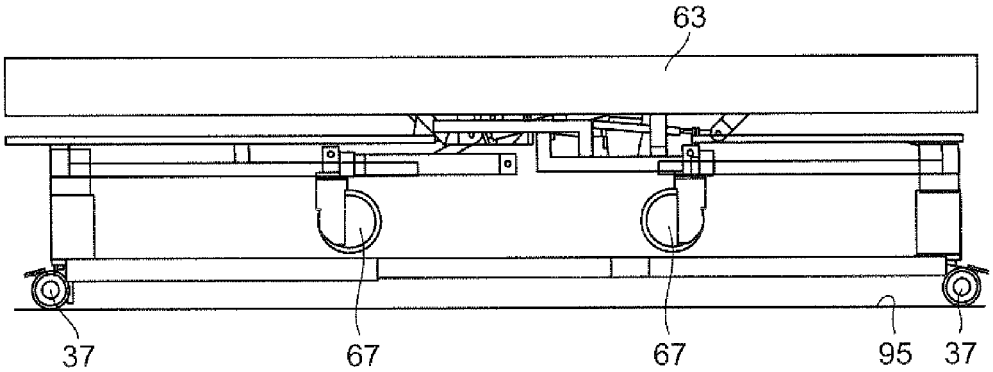
FIG. 19A is a right side view of the separable bed in the combined state at the start of the lowering of the upper frame, in the separable bed of the third embodiment.
Figure 19B:
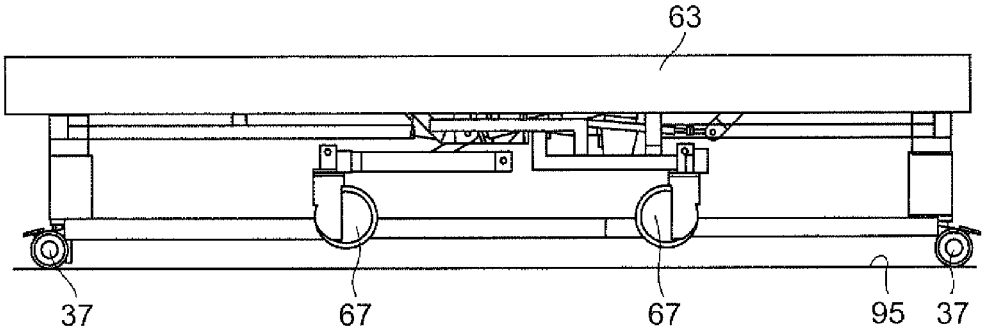
FIG. 19B is a right side view of the separable bed in the combined state in the middle of the lowering of the upper frame, in the third embodiment.
Figure 19C:
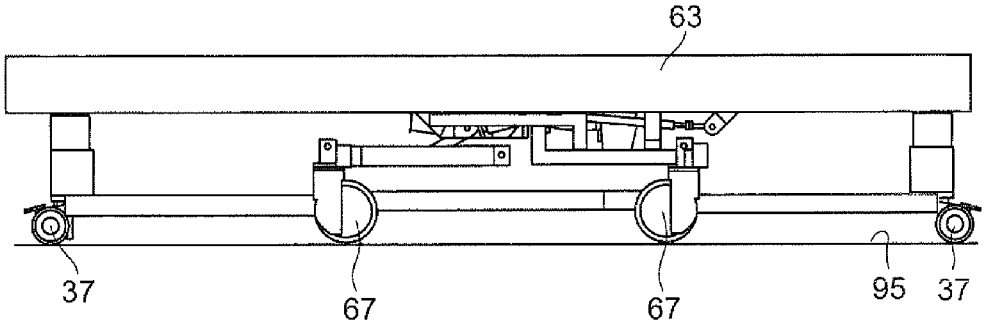
FIG. 19C is a right side view of the separable bed in the combined state at a lower limit position of the upper frame, in the third embodiment.

In each of the above embodiments and modifications, the bed 1 may be composed by a bed 61 composed such that a wheelchair portion 61*b* and a bed portion 61*a* are separably combined, as shown in FIG. 17A and FIG. 17B. Hereinafter, this example is described as a third embodiment of the present invention.

Figure 20:
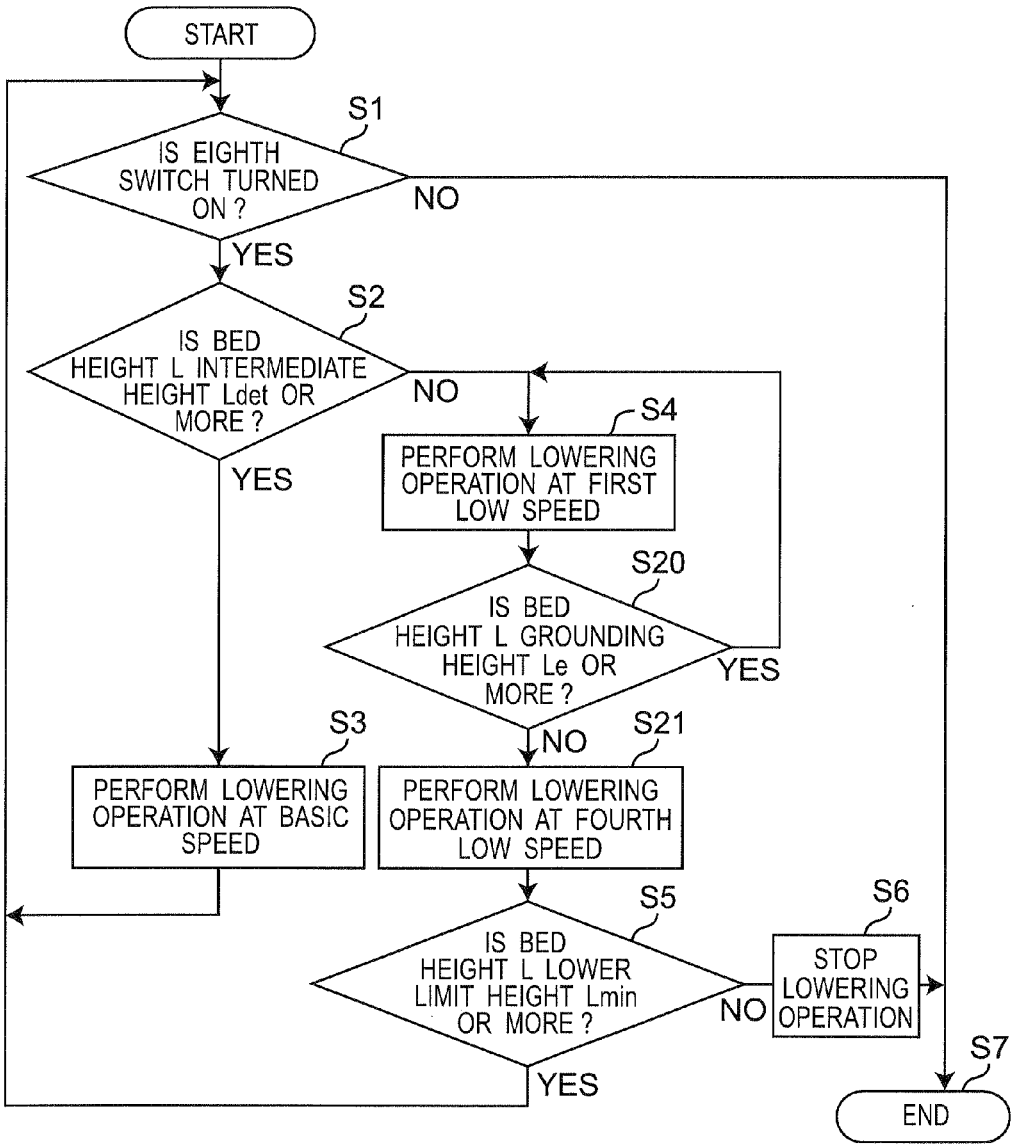
FIG. 20 is a flowchart showing ninth lowering operation in the third embodiment.
Figure 21:
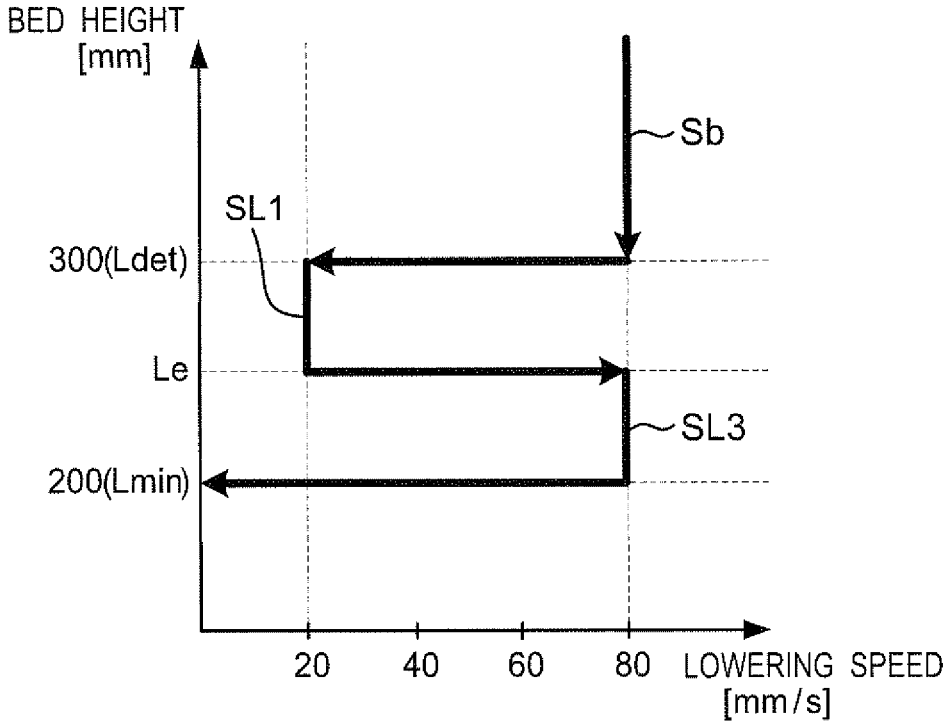
FIG. 21 is a control mode view showing speed change of the ninth lowering operation in the third embodiment.
Figure 22:
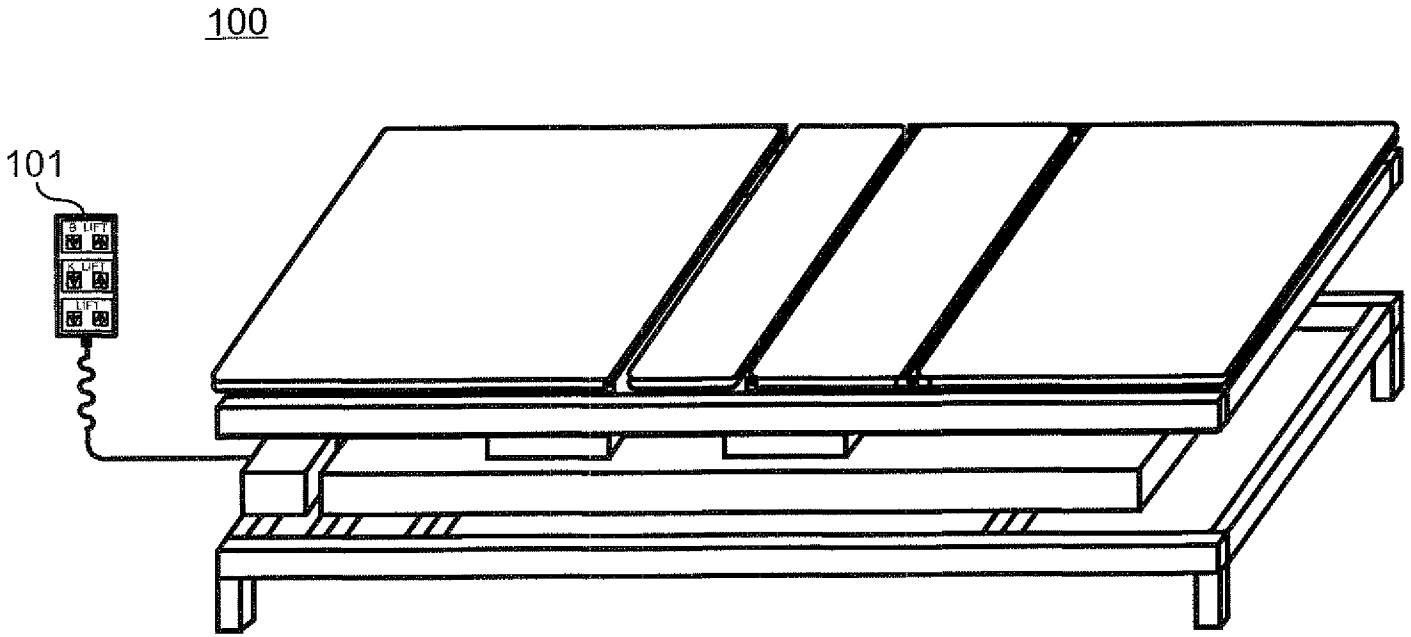
FIG. 22 is a schematic perspective view of a conventional electric bed.

FIG. 17A and FIG. 17B are a schematic perspective view showing a separated state of a separable bed of the third embodiment of the present invention, and a schematic perspective view showing a combined state, respectively. FIG. 18A to FIG. 19C are a front view and a right side view of the bed in the combined state at start of lowering of a second frame (upper frame), a front view and a right side view of the bed in the combined state in the middle of the lowering of the second frame (upper frame), and a front view and a right side view of the bed in the combined state at a lower limit position of the second frame (upper frame), respectively. FIG. 20 and FIG. 21 are a flowchart showing ninth lowering operation according to the third embodiment, and a control mode view showing speed change.

The bed 61 that is an example of the separable bed according to this third embodiment is an electric reclining bed for care that changes its posture by, for example, a second driver 4*a* and a third driver 4*b* in the combined state. Additionally, the wheelchair portion 61*b* is an electric reclining wheelchair that changes its posture by, for example, a wheelchair driver (not shown) in the separated state.

The wheelchair portion 61*b* is composed of at least a first seat portion 63 composed by freely bendably coupling a plurality of divided portions, and a first main body portion 64. The first main body portion 64 has a first guide portion 65 that supports the first seat portion 63 and is composed by freely bendably coupling a plurality of divided portions, a first base portion 66 fixed to a part of the first guide portion 65 (e.g., part corresponding to the vicinity of buttocks of a care receiver), a plurality of traveling wheels 67 that support the first base portion 66 and move the whole of the wheelchair portion 61*b*. The first seat portion 63 is, for example, a wheelchair seat portion. The first main body portion 64 is, for example, a wheelchair main body portion. The first guide portion 65 is, for example, a wheelchair main body portion. The first base portion 66 is, for example, a wheelchair base portion.

The bed portion 61*a* has a recessed portion 61*c* at one side portion of the center. When the first main body portion 64 enter the recessed portion 61*c* to be brought into a combination preparation state, a part of a second frame 2*b* of the bed portion 61*a* is disposed on a lower surface of the first seat portion 63, so that the first seat portion 63 become risable and lowerable together with the second frame 2*b*. As shown in FIG. 18A to FIG. 19C, the first frame 2*a* has wheels 37 at lower ends of four corners, and is movable.

Accordingly, when a first driver 4*c* of the bed portion 61*a* is driven to rise the second frame 2*b* after the combination preparation state, the first seat portion 63 rises integrally with a bottom 3 of the bed portion 61*a*, so that the traveling wheels 67 are spaced from the floor surface 95. Thus, in a state where the traveling wheels 67 are spaced from the floor surface 95, there is a possibility that a foot or the like of a caregiver or a care receiver is sandwiched between the traveling wheels 67 and the floor surface 95, and therefore attention is needed.

On the other hand, when the first driver 4*c* is reversely driven to lower the second frame 2*b* and to lower the first seat portion 63 integrally with the bottom 3 of the bed portion 61*a*, the traveling wheels 67 are grounded on the floor surface 95 when the bed height L is between the intermediate height Ldet and the lower limit height Lmin. At the bed height at a point where the traveling wheels 67 are in contact with the floor surface 95 (grounding height Le), there is no clearance between the traveling wheels 67 and the floor surface 95, and therefore there is no possibility that a foot or the like of a caregiver or a care receiver is sandwiched between the traveling wheels 67 and the floor surface 95. Therefore, a necessity of making a lowering speed to become slow at the bed height L that is between the intermediate height Ldet and the lower limit height Lmin is eliminated. Therefore, after the grounding height Le is previously stored in a storage 99, and a second decision unit 98 decides that the bed height L reaches the grounding height Le, the first driver 4*c* is driven under control of a control device 12, to lower the second frame 2*b* at an arbitrary setting speed that is between a first low speed LV1 and the basic speed BV, which is the ninth lowering operation.

Specifically, in the ninth lowering operation of this third embodiment, Step S20 and Step S21 are added between Step S4 and Step S5 of FIG. 3.

Accordingly, similarly to FIG. 3, in a case where the second decision unit 98 decides that the bed height L is less than a first predetermined height (intermediate height Ldet as an example) when an eighth switch 13*f* is depressed (No in Step S2), the control device 12 drives the first driver 4*c* so as to lower the second frame 2*b* at the first low speed LV1 (Step S4). Thereafter, in Step S20, the second decision unit 98 decides whether or not the bed height L is the grounding height Le or more. In a case where the second decision unit 98 decides that the bed height L is less than the grounding height Le in Step S20, the process proceeds to Step S21. In Step S21, the first driver 4*c* is driven under control of the control device 12 to lower the second frame 2*b* at a fourth low speed LV4. Thereafter, the process proceeds to Step S5. On the other hand, in a case where the second decision unit 98 decides that the bed height L is the grounding height Le or more in Step S20, the process returns to Step S4, and the first driver 4*c* is driven under control of the control device 12 to continue to perform the lowering operation of the second frame 2*b* at the first low speed LV1.

The fourth low speed LV4 is preset to an arbitrary value that is the basic speed BV or less and is the first low speed LV1 or more to store the arbitrary value in the storage 99.

In a case where this third embodiment is applied to the third lowering operation of FIG. 8, the fourth low speed LV4 is simply set to a speed that is the basic speed BV or less, and is the second low speed LV2 faster than the first low speed LV1 or more.

The eighth switch 13*f* of the remote controller 13 may include a first switch 13*g* and a second switch 13*h*. The first switch 13*g* is, for example, a vertical rising and lowering switch (lifting switch) for performing only rising and lowering operation of the second frame 2*b*. The second switch 13*h* is, for example, a rising and lowering switch for combination and separation for lifting the second frame 2*b*, and performing combination and separation of the wheelchair portion 61*b* and the bed portion 61*a*.

By appropriately combining arbitrary embodiment(s) or modification(s) of the above various embodiments or modifications, the effects possessed by the respective embodiments or modifications can be produced. Additionally, combination between characteristics in different embodiments or modifications is possible as well.

INDUSTRIAL APPLICABILITY

An electric bed of the present invention is useful for, for example, an ordinary home, a caring facility, or a hospital facility where a person who needs care.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. An electric bed comprising:

a first driver that performs rising and lowering operation of a second frame with respect to a first frame;

a controller that controls the first driver; and an input unit that instructs the controller by switch manipulation of a lowering switch of the input unit, wherein the controller controls the first driver to lower the second frame at a basic speed when a bed height is a first predetermined height or more during depression of the lowering switch, and to lower the second frame at a first low speed slower than the basic speed without stopping once when the bed height is less than the first predetermined height during the depression of the lowering switch, in a case where the bed height is a height of an upper surface of the second frame.

2. The electric bed according to claim 1, wherein the basic speed and the first low speed each are a constant speed.

3. The electric bed according to claim 1, wherein the electric bed is a bed composed by separably combining a wheelchair portion with a bed portion, the lowering switch of the input unit includes a first switch that rises and/or lowers the second frame, and a second switch that rises and/or lowers the second frame and combines and/or separates the wheelchair portion and the bed portion, and the controller controls the first driver to lower the second frame at the basic speed when the bed height is the first predetermined height or more during depression of the second switch, and to lower the second frame at the first low speed when the bed height is less than the first predetermined height during the depression of the second switch.

4. The electric bed according to claim 2, wherein the electric bed is a bed composed by separably combining a wheelchair portion with a bed portion, the lowering switch of the input unit includes a first switch that rises and/or lowers the second frame, and a second switch that rises and/or lowers the second frame and combines and/or separates the wheelchair portion and the bed portion, and the controller controls the first driver to lower the second frame at the basic speed when the bed height is the first predetermined height or more during depression of the second switch, and to lower the second frame at the first low speed when the bed height is less than the first predetermined height during the depression of the second switch.

5. The electric bed according to claim 3, wherein the controller controls the first driver to lower the second frame at the basic speed when it is detected that a wheel of the wheelchair portion is grounded during the depression of the second switch and the lowering of the second frame at the first low speed.

6. The electric bed according to claim 1, wherein a second low speed that is slower than the basic speed and is faster than the first low speed is set, and the controller controls the first driver to lower the second frame at the second low speed, in a case where the depression of the lowering switch is released during the lowering of the second frame at the first low speed, and the lowering switch is thereafter depressed again.

7. The electric bed according to claim 2, wherein a second low speed that is slower than the basic speed and is faster than the first low speed is set, and the controller controls the first driver to lower the second frame at the second low speed, in a case where the depression of the lowering switch is released during the lowering of the second frame at the first low speed, and the lowering switch is thereafter depressed again.

8. The electric bed according to claim 3, wherein a second low speed that is slower than the basic speed and is faster than the first low speed is set, and the controller controls the first driver to lower the second frame at the second low speed, in a case where the depression of the lowering switch is released during the lowering of the second frame at the first low speed, and the lowering switch is thereafter depressed again.

9. The electric bed according to claim 6, wherein the controller controls the first driver to lower the second frame at the second low speed, in a case where the second frame is lowered at the first low speed for a predetermined time in a state where the bed height is less than the first predetermined height.

10. The electric bed according to claim 8, wherein the controller controls the first driver to lower the second frame at the second low speed, in a case where the second frame is lowered at the first low speed for a predetermined time in a state where the bed height is less than the first predetermined height.

11. The electric bed according to claim 1, wherein a third low speed that is slower than the basic speed, is faster than the first low speed, and whose speed changes in accordance with the bed height when the lowering switch is depressed is set, and the controller controls the first driver to lower the second frame at the third low speed, in a case where the depression of the lowering switch is released during the lowering of the second frame at the first low speed, and the lowering switch is thereafter depressed again.

12. The electric bed according to claim 2, wherein a third low speed that is slower than the basic speed, is faster than the first low speed, and whose speed changes in accordance with the bed height when the lowering switch is depressed is set, and the controller controls the first driver to lower the second frame at the third low speed, in a case where the depression of the lowering switch is released during the lowering of the second frame at the first low speed, and the lowering switch is thereafter depressed again.

13. The electric bed according to claim 3, wherein a third low speed that is slower than the basic speed, is faster than the first low speed, and whose speed changes in accordance with the bed height when the lowering switch is depressed is set, and the controller controls the first driver to lower the second frame at the third low speed, in a case where the depression of the lowering switch is released during the lowering of the second frame at the first low speed, and the lowering switch is thereafter depressed again.

14. The electric bed according to claim 1, wherein the first low speed is a variable first low speed in which the lower the bed height is, the slower the lowering speed is.

15. The electric bed according to claim 2, wherein the first low speed is a variable first low speed in which the lower the bed height is, the slower the lowering speed is.

16. The electric bed according to claim 3, wherein the first low speed is a variable first low speed in which the lower the bed height is, the slower the lowering speed is.

17. The electric bed according to claim 6, wherein the second low speed is a variable second low speed in which the lower the bed height is, the slower the lowering speed is.

18. The electric bed according to claim 8, wherein the second low speed is a variable second low speed in which the lower the bed height is, the slower the lowering speed is.

19. The electric bed according to claim 1, wherein a variable third low speed that is slower than the basic speed, and is faster than the first low speed, and whose initial speed changes in accordance with the bed height when the lowering switch is depressed, is set, and the controller controls the first driver to lower the second frame at the variable third low speed in which the lower the bed height is, the slower the lowering speed is, in a case where the depression of the lowering switch is released during the lowering of the second frame at the first low speed, and the lowering switch is thereafter depressed again.

20. The electric bed according to claim 3, wherein a variable third low speed that is slower than the basic speed, and is faster than the first low speed, and whose initial speed changes in accordance with the bed height when the lowering switch is depressed, is set, and the controller controls the first driver to lower the second frame at the variable third low speed in which the lower the bed height is, the slower the lowering speed, in a case where the depression of the lowering switch is released during the lowering of the second frame at the first low speed, and the lowering switch is thereafter depressed again.

* * * * *